US007580796B2

(12) United States Patent
Soliman et al.

(10) Patent No.: US 7,580,796 B2
(45) Date of Patent: Aug. 25, 2009

(54) METHODS AND SYSTEMS FOR EVALUATING AND TREATING PREVIOUSLY-FRACTURED SUBTERRANEAN FORMATIONS

(75) Inventors: Mohamed Y. Soliman, Cyress, TX (US); Loyd E. East, Tomball, TX (US); Neil A. Stegent, Cypress, TX (US); Joseph Ansah, Sugar Land, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 11/888,277

(22) Filed: Jul. 31, 2007

(65) Prior Publication Data

US 2009/0037112 A1 Feb. 5, 2009

(51) Int. Cl.
*G01V 9/00* (2006.01)

(52) U.S. Cl. ..... 702/11

(58) Field of Classification Search ..... 702/11, 702/34–36, 166, 170; 166/250.1, 308.1
See application file for complete search history.

(56) References Cited

U.S. PATENT DOCUMENTS

| | | | | |
|---|---|---|---|---|
| 5,036,919 | A | 8/1991 | Thomas et al. | 166/271 |
| 6,598,481 | B1 | 7/2003 | Schultz | 73/702 |
| 2002/0043370 | A1 | 4/2002 | Poe | 166/250.07 |
| 2004/0049346 | A1* | 3/2004 | Despax et al. | 702/12 |
| 2004/0200617 | A1* | 10/2004 | Stephenson et al. | 166/278 |
| 2005/0216198 | A1* | 9/2005 | Craig | 702/12 |
| 2006/0113077 | A1 | 6/2006 | Willberg et al. | 166/280.1 |
| 2006/0175059 | A1* | 8/2006 | Sinclair et al. | 166/283 |
| 2007/0008331 | A1 | 1/2007 | Atkin | 345/581 |
| 2007/0083331 | A1* | 4/2007 | Craig | 702/13 |
| 2008/0183451 | A1* | 7/2008 | Weng et al. | 703/10 |

FOREIGN PATENT DOCUMENTS

| | | |
|---|---|---|
| WO | 2005/095756 A1 | 10/2005 |
| WO | 2005/095757 A1 | 10/2005 |

OTHER PUBLICATIONS

"Advances in Well Test Analysis" by Robert C. Earlougher, Jr. with Marathon Oil Co., 1977.
Search Report and Written Opinion for International Application No. PCT/GB2008/002621, Jul. 30, 2008.

* cited by examiner

*Primary Examiner*—Michael P. Nghiem
*Assistant Examiner*—Cindy H Khuu
(74) *Attorney, Agent, or Firm*—Robert A. Kent; Baker Botts L.L.P.

(57) ABSTRACT

Methods, computer programs, and systems for evaluating and treating previously-fractured subterranean formations are provided. An example method includes, for one or more of the one or more layers, determining whether there are one or more existing fractures in the layer. The method further includes, for one or more of the one or more existing fractures, measuring one or more parameters of the existing fracture and determining conductivity damage to the existing fracture, based, at least in part, on one or more of the one or more measured parameters of the existing fracture. The method further includes selecting one or more remediative actions for the existing fracture, based, at least in part, on the conductivity damage.

20 Claims, 29 Drawing Sheets

METHODS AND SYSTEMS FOR EVALUATING AND TREATING PREVIOUSLY-FRACTURED SUBTERRANEAN FORMATIONS

BACKGROUND

The present disclosure relates generally to subterranean treatment operations, and more particularly to methods and systems for evaluating and treating previously-fractured subterranean formations.

Hydrocarbon-producing wells are often stimulated by hydraulic fracturing operations, wherein a fracturing fluid is introduced into a hydrocarbon-producing zone within a subterranean formation at a hydraulic pressure sufficient to create or enhance at least one fracture therein. A fracture typically has a narrow opening that extends laterally from the well. To prevent such opening from closing completely when the fracturing pressure is relieved, the fracturing fluid typically carries a granular or particulate material, referred to as "proppant," into the opening of the fracture. This material generally remains in the fracture after the fracturing process is finished, and serves to hold apart the separated earthen walls of the formation, thereby keeping the fracture open and enhancing flow paths through which hydrocarbons from the formation can flow into the well bore at increased rates relative to the flow rates through the unfractured formation. FIG. 1 illustrates an example of a proppant-filled fracture in a subterranean formation. FIG. 2 illustrates an example of fluid flowing through a fracture in a subterranean formation into a well bore.

Generally, designers of fracturing operations have assumed uniform fracture conductivity. However, some prior publications have pointed out that loss of fracture conductivity near the well bore may significantly adversely impact the productivity of a fractured well bore. This may be particularly true in cases where transverse fractures are created that intersect a horizontal well, or a horizontal portion of a well bore.

It has been found, however, that most fractures do not have a uniform conductivity. In some instances, the conductivity of a fracture may be varied intentionally, as in cases where an operator may desire to have higher conductivity and/or stronger proppant near the well bore. In some cases, an operator may desire to prevent backflow of proppant by placing, in the near-well-bore area, a specially designed proppant having a different conductivity and/or physical properties than that of the proppant used for the majority of the fracturing operation. In other instances, the conductivity of the fracture may vary as a result of the fracturing process, as in cases where the fracture propagates across multiple formations with different properties, which may cause the conductivity of the fracture to vary in the vertical direction as well as the horizontal direction. It is not uncommon for fracture conductivity in the near-well-bore area to decline significantly with time and adversely affect the performance of the fractured well.

Impairment or loss of fracture conductivity may occur for a variety of reasons. For example, weakening of the proppant over time may impair fracture conductivity. As another example, fracture conductivity may be impaired by increasing closure pressure that may be caused by continued depletion of hydrocarbons in the formation as the well is produced. Fracture tortuosity also may lead to impairment of conductivity in some cases. Additionally, in some cases proppant may be over-displaced in certain regions of the fracture, which may reduce the amount of proppant that is deposited in the near-well-bore area. FIG. 3 illustrates an example of a subterranean fracture having a damaged area.

The effect of fracture conductivity damage may be greatly pronounced in previously-fractured horizontal wells. The performance of transverse fractures having finite conductivity has only recently been studied. Transverse fractures in a horizontal well differ from a vertically fractured well, in that the fluid in the fracture for a horizontal well converges radially toward the well bore as illustrated in FIGS. 4 and 5. FIGS. 4 and 5 illustrate different views of the convergence of fluid inside an exemplary transverse fracture intersecting an exemplary horizontal well bore. Such convergence may yield a flow regime different than the flow regime that may be expected when a vertical well is fractured.

Conventionally, operators evaluating well bores that are suspected to suffer from lost or impaired fracture conductivity have lacked means to differentiate between the loss of conductivity over the entire length of the fracture, and the loss of conductivity in only the near-well-bore area. For example, a refracture-candidate diagnostic regime has been proposed that comprises, among other things, a brief injection of fluid above the fracture initiation and propagation pressure for a formation, followed by an extended period of monitoring the decrease in pressure (e.g., "pressure-falloff"). The pressure falloff data is then plotted on a variable-storage, constant-rate drawdown type curve for a well producing from one or more vertical fractures in an infinite-acting reservoir. This diagnostic regime may determine, among other things, whether a pre-existing fracture exists, as well as whether such pre-existing fracture may be damaged. This regime also may provide estimates of, among other things, the fracture conductivity, the effective fracture half-length, the reservoir transmissibility, and the average reservoir pressure. However, where a pre-existing fracture exists, and is in damaged condition, conventional diagnostic regimes such as the one described above fail to diagnose whether such damage resides in the vicinity of the well bore, or whether the damage exists over a significant length of the fracture. This is problematic, because if an estimation of damage to a fracture leads an operator to conclude (perhaps erroneously) that conductivity has been lost over a significant length of the fracture, the operator may deem further remedial operations to be unjustified. However, if an operator estimating damage to a fracture could accurately determine that the loss of conductivity was confined to only about the near-well-bore area, the operator may justify a remedial operation that restores conductivity in or about the near well bore region.

SUMMARY OF THE INVENTION

The present invention relates generally to subterranean treatment operations, and more particularly to methods and systems for evaluating and treating previously-fractured subterranean formations.

In a first aspect, the invention features a method for treating a subterranean formation. The subterranean formation includes one or more layers. The method includes, for one or more of the one or more layers, determining whether there are one or more existing fractures in the layer. The method further includes, for one or more of the one or more existing fractures, measuring one or more parameters of the existing fracture and determining conductivity damage to the existing fracture, based, at least in part, on one or more of the one or more measured parameters of the existing fracture. The method further includes selecting one or more remediative actions for the existing fracture, based, at least in part, on the conductivity damage.

In a second aspect, the invention features a computer program, stored in a tangible medium, for evaluating a subterranean formation, the subterranean formation comprising one or more layers. The computer program includes executable instructions that cause at least one processor to, for one or more of the one or more layers, determine whether there are one or more existing fractures in the layer; for one or more of the one or more existing fractures: measure one or more parameters of the existing fracture; determine conductivity damage to the existing fracture, based, at least in part, on one or more of the one or more measured parameters of the existing fracture; and select one or more remediative actions for the existing fracture, based, at least in part, on the conductivity damage.

In a third aspect, the invention features a system for treating a subterranean formation, the subterranean formation comprising one or more layers. The system includes one or more sensors to measure one or more parameters of one or more existing fractures; at least one processor; and a memory comprising executable instructions. When executed the executable instruction cause the at least one processor to: for one or more of the one or more layers, determine whether there are one or more existing fractures in the layer; for one or more of the one or more existing fractures: receive measurements of one or more parameters of one or more existing fracture; determine conductivity damage to the existing fracture, based, at least in part, on one or more of the one or more measured parameters of the existing fracture; and select one or more remediative actions for the existing fracture, based, at least in part, on the conductivity damage.

The features and advantages of the present disclosure will be readily apparent to those skilled in the art upon a reading of the description of exemplary embodiments, which follows.

BRIEF DESCRIPTION OF THE DRAWINGS

A more complete understanding of the present disclosure and advantages thereof may be acquired by referring to the following description taken in conjunction with the accompanying drawing, wherein.

Figure 1:
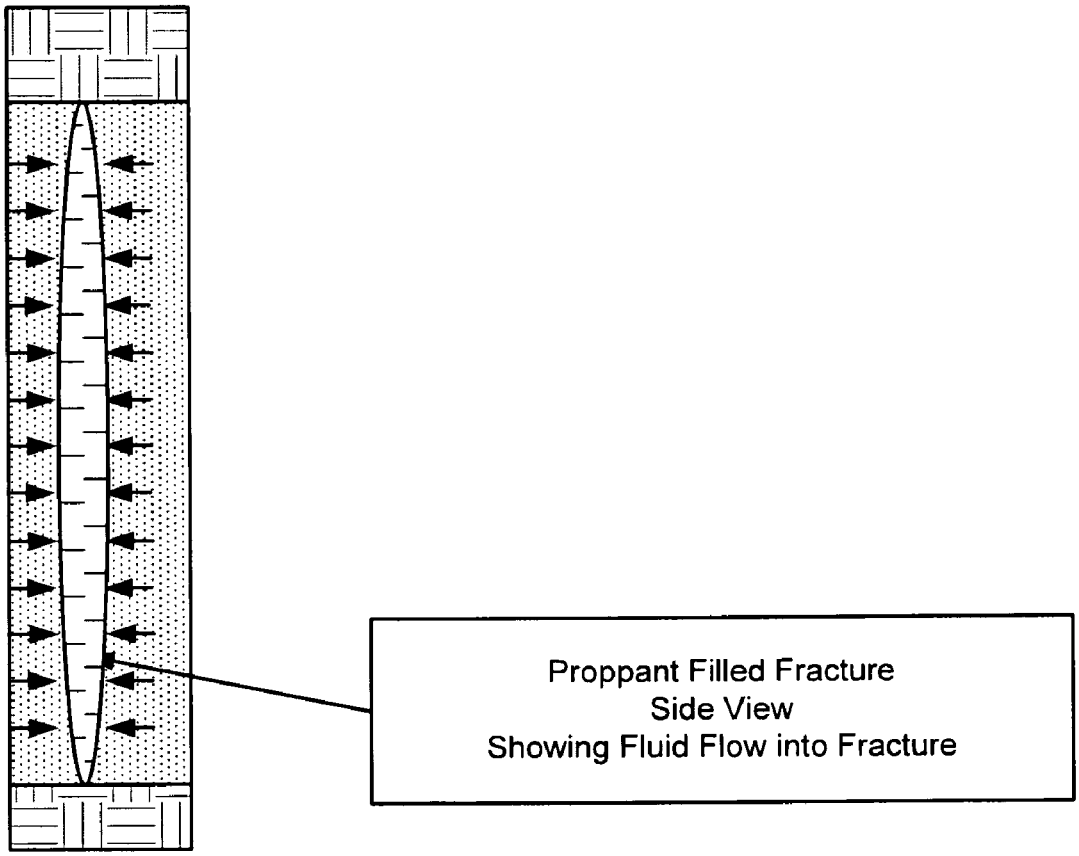
FIG. 1 PRIOR ART
FIG. 1 illustrates an example of a proppant-filled fracture in a subterranean formation.
Figure 2:
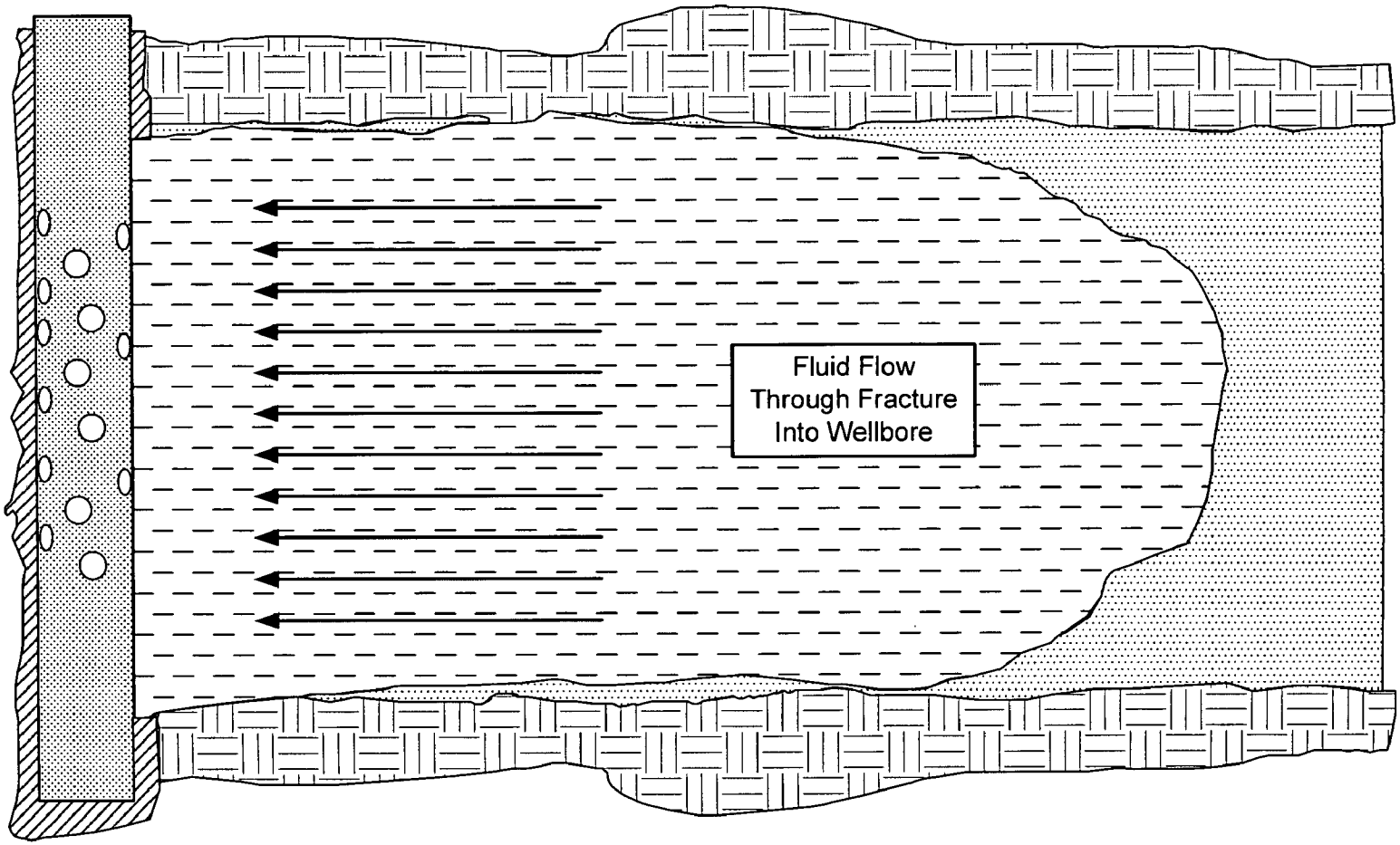
FIG. 2 PRIOR ART
FIG. 2 illustrates an example of fluid flowing through a fracture in a subterranean formation into a well bore.
Figure 3:
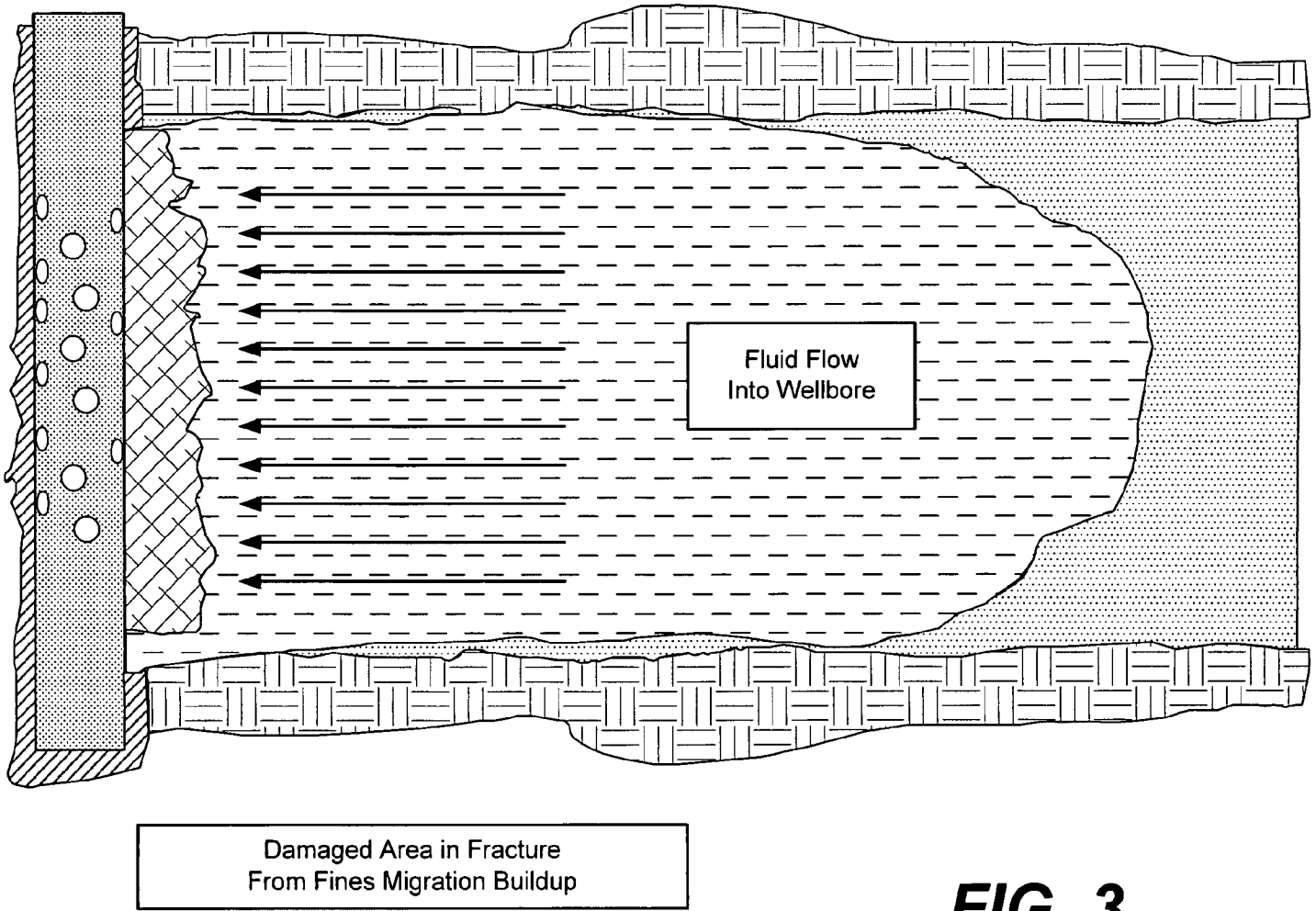
FIG. 3 PRIOR ART
FIG. 3 illustrates an example of a subterranean fracture having a damaged area.

While the present disclosure is susceptible to various modifications and alternative forms, specific exemplary embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DESCRIPTION OF EXEMPLARY EMBODIMENTS

The present disclosure relates generally to subterranean treatment operations, and more particularly to methods and systems for evaluating and treating previously-fractured subterranean formations.

In accordance with the present disclosure, methods are provided to identify previously-fractured wells that may be producing below their optimum potential, design a corrective action, and perform the corrective action so as to enhance the production derived from these wells. The methods of the present disclosure generally comprise performing testing on a previously-fractured well in a subterranean formation, processing and plotting the results of such testing, and using type-curve analysis to evaluate the plotted results to thereby determine parameters such as degree of damage and depth of damage to the existing fracture. Once these parameters have been determined, the methods of the present disclosure contemplate using these parameters to design a treatment operation to repair at least a portion of the damage to the fracture.

The Subterranean Environment

Figure 27:
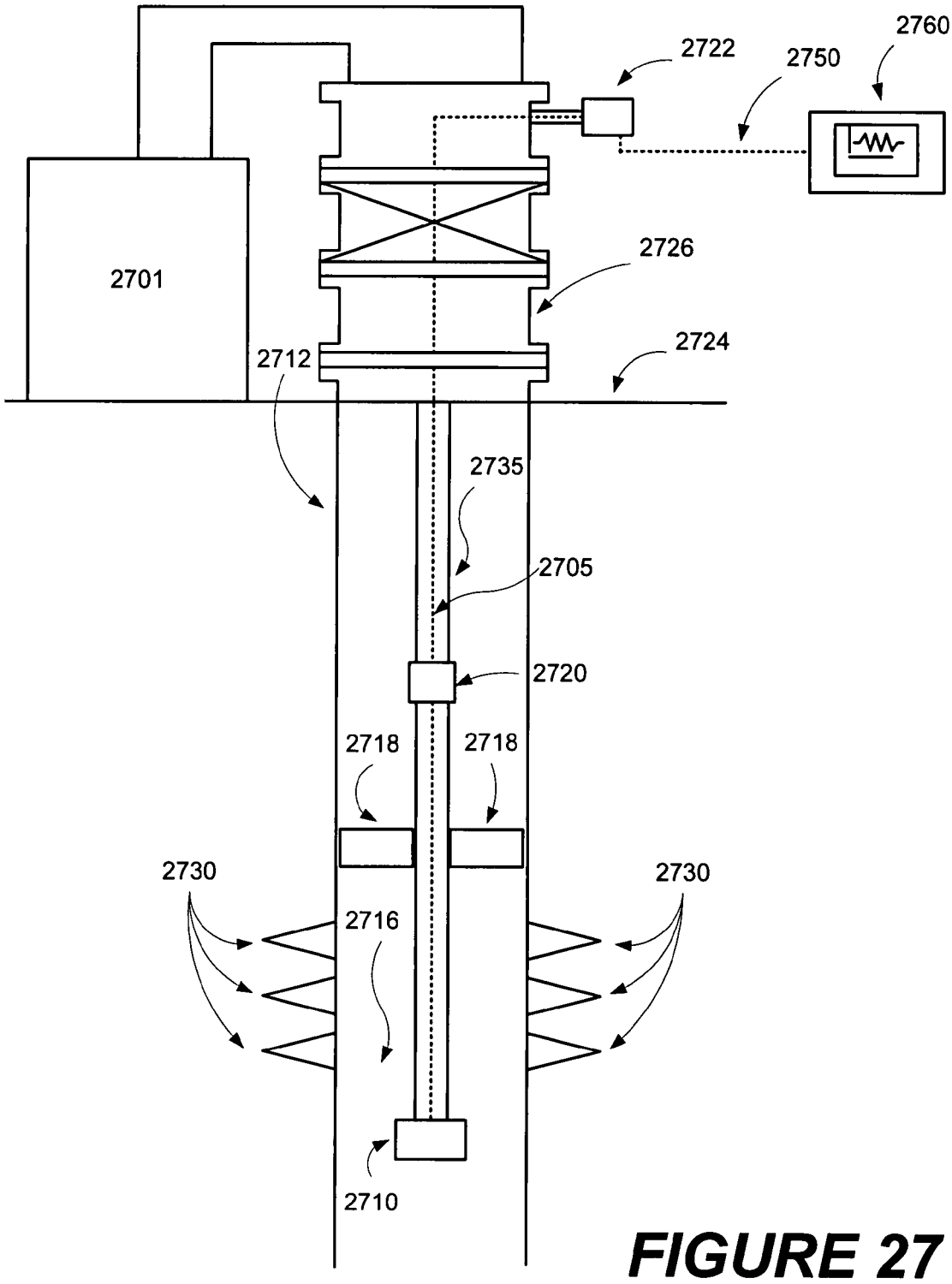
FIG. 27 depicts an illustration of a well bore in a subterranean formation.

FIG. 27 depicts a schematic representation of a subterranean well bore 2712 with which one or more sensors (e.g., sensing device 2710) may be associated such that physical property data (e.g., pressure signals, temperature signals, and the like) may be generated. The physical property data may be sensed using any suitable technique. For example, sensing may occur downhole with real-time data telemetry to the surface, or by delayed transfer (e.g., by storage of data downhole, followed by subsequent telemetry to the surface or subsequent retrieval of the downhole sensing device, for example). Furthermore, the sensing of the physical property data may be performed at any suitable location, including, but not limited to, the tubing 2735 or the surface 2724. In general, any sensing technique and equipment suitable for detecting the desired physical property data with adequate sensitivity and/or resolution may be used. An example of a suitable sensing device 10 is a pressure transducer disclosed in commonly owned U.S. Pat. No. 6,598,481, the relevant disclosure of which is hereby incorporated herein by reference. In certain exemplary embodiments of the present disclosure, a sensing device 2710 may be used that comprises a pressure transducer that is temperature-compensated. In one exemplary embodiment of the present disclosure, sensing device 2710 may be lowered into well bore 2712 and positioned in a downhole environment 2716. In certain exemplary embodiments of the present disclosure, sensing device 2710 may be positioned below perforations 2730. In certain exemplary embodiments of the present disclosure, downhole environment 2716 may be sealed off with packing 2718, wherein access is controlled with valve 2720.

The physical property data is ultimately transmitted to the surface by transmitter 2705 at a desired time after having been sensed by the sensing device 2710. As noted above, such transmission may occur immediately after the physical property data is sensed, or the data may be stored and transmitted later. Transmitter 2705 may comprise a wired or wireless connection. In one exemplary embodiment of the present disclosure, the sensing device 2710, in conjunction with associated electronics, converts the physical property data to a first electronic signal. The first electronic signal is transmitted through a wired or wireless connection to signal processor unit 2722, preferably located above the surface 2724 at wellhead 2726. Signal processing unit 2722 includes one or more processors, memory, and one or more input devices, and one or more output devices. The memory of processing unit 2722 includes instructions that cause the one or more processor to perform one or more operations. In certain exemplary embodiments of the present disclosure, the signal processor unit 2722 may be located within a surface vehicle (not shown) wherein the fracturing operations are controlled. Signal processor unit 2722 may perform mathematical operations on a first electronic signal, further described later in this application. In certain exemplary embodiments, signal processor unit 2722 may be a computer comprising a software program for use in performing mathematical operations. An example of a suitable software program is commercially available from The Math Works, Inc., of Natick, Mass., under the trade name "MATLAB." In certain exemplary embodiments of the present disclosure, output 2750 from signal processor unit 2722 may be plotted on display 2760.

Testing Methods that may be used with the Present Disclosure

The well bore evaluation methods of the present disclosure make use of a variety of conventional tests, including, for example and without limitation: an injection falloff test; a pressure buildup in which the well is shut in for a period of time during which the ensuing pressure increase is measured; and long-term monitoring of pressure and production rate; and the like. Some of these conventional tests will be briefly described herein.

Figure 6A:
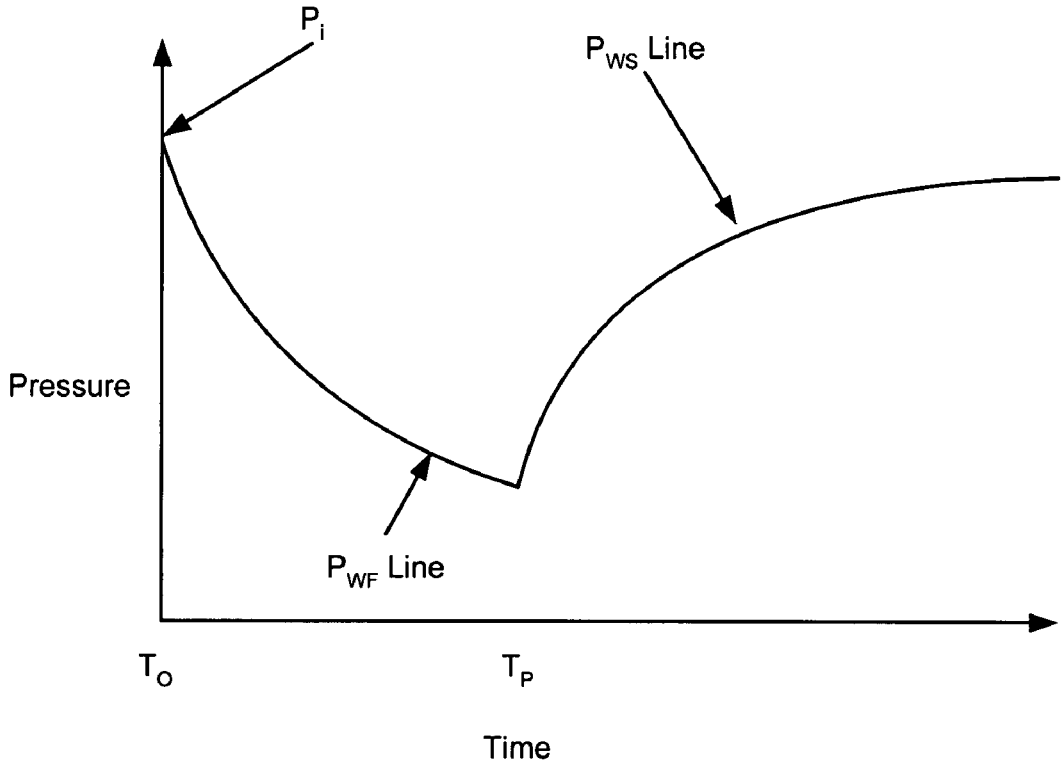
FIG. 6A depicts a graphical representation of an exemplary pressure signal that may be generated during an exemplary well testing operation.

As noted above, the physical property data that is sensed in the subterranean formation may comprise a pressure signal. Referring now to FIG. 6A, a graphical representation of a pressure signal is illustrated therein. The graph in FIG. 6A is labeled to denote that the horizontal axis represents time, and the vertical axis represents pressure. The pressure signal in FIG. 6A pertains to a well that initially resided in a static condition, with initial pressure of Pi at time $T_0$. At time $T_0$, the pressure throughout the reservoir was uniform at Pi. Immediately after time $T_0$, the well was placed on production, which caused the well bore pressure to decline until time $T_p$. The decline in well bore pressure between time $T_0$ and time $T_p$ may be seen by following the "Pwf Line" in FIG. 6A from time $T_0$ to time $T_p$. At time $T_p$, the well was shut in, which caused the pressure to rise along the Pws line.

Figure 6B:
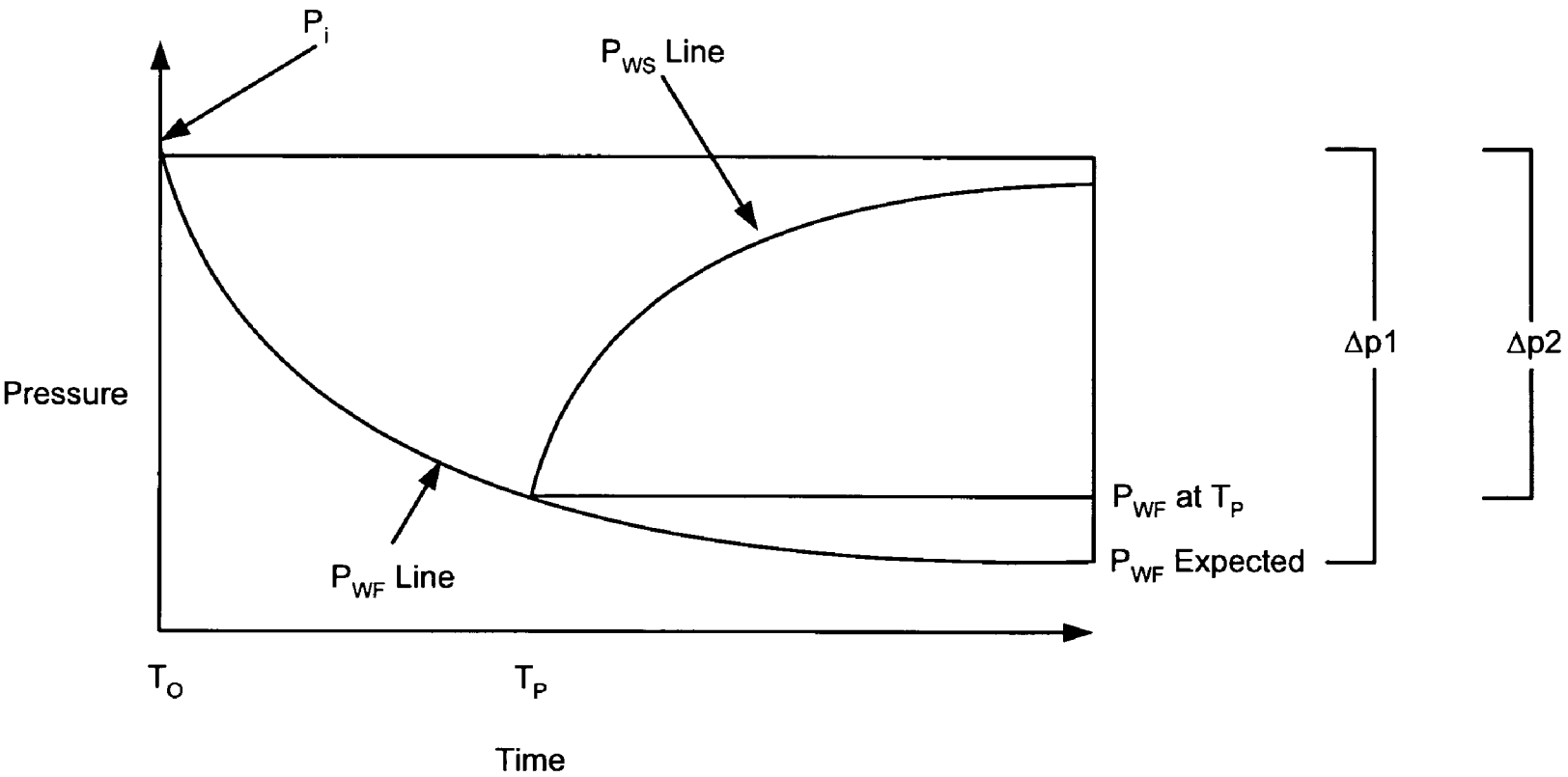
FIG. 6B depicts the graphical representation of FIG. 6A, along with additional analysis that may be performed on the exemplary pressure signal.

FIG. 6B illustrates the pressure signal of FIG. 6A, with some additional information. FIG. 6B also shows a horizontal line ($P_{wf}$ at time $T_p$, the time at which the well was shut in). FIG. 6B also extends the $P_{wf}$ Line beyond time $T_p$, showing the pressure that would have been observed if the well had not been shut in. As illustrated in FIG. 6B, the well bore pressure ultimately would have reached "$P_{wf}$ Expected" if the well had not been shut in. As illustrated in FIG. 6B, "Δp1" denotes the pressure drop during the shut-in period measured from Pi to $P_{wf}$ Expected, while "Δp2" denotes the pressure drop during the shut-in period measured from Pi to the pressure at shut in ($P_{wf}$ at time $T_p$).

Figure 7:
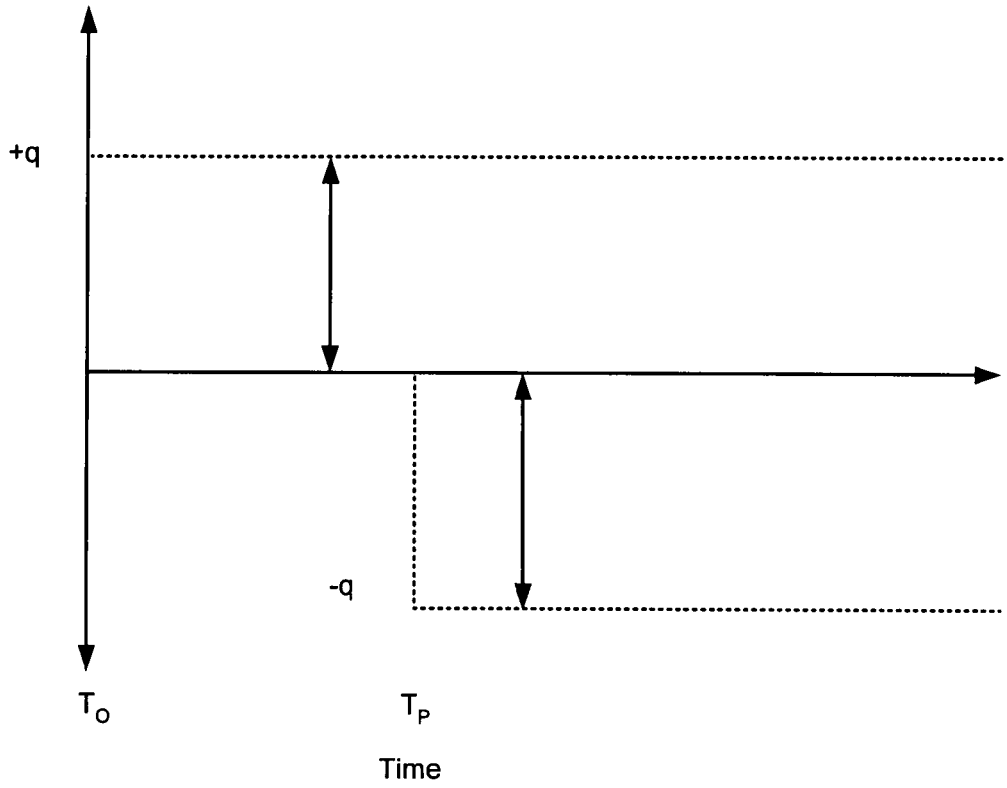
FIG. 7 depicts a graphical representation of a pressure buildup test.
Figure 8:
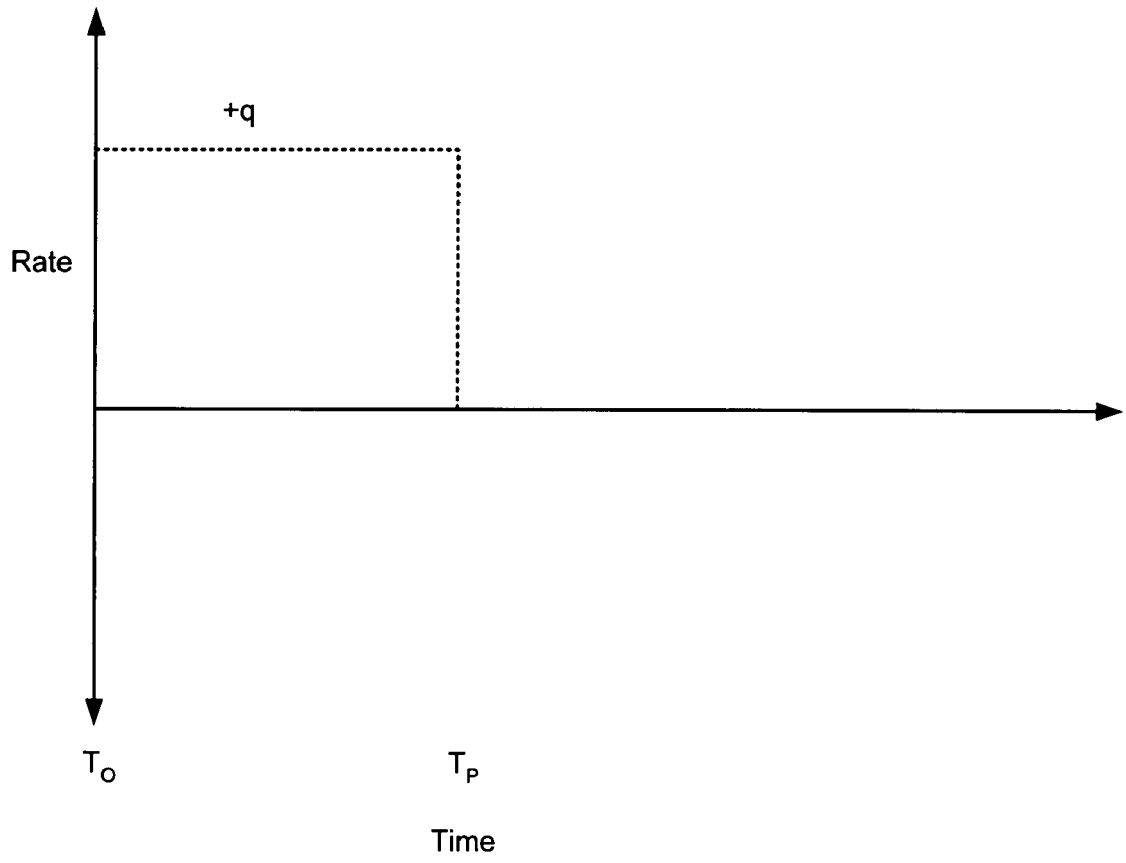
FIG. 8 depicts another graphical representation of a pressure buildup test.

Referring now to FIGS. 7 and 8, graphical representations of pressure buildup tests are illustrated therein. Though the graphs illustrated in FIGS. 7 and 8 are referred to herein as "pressure buildup tests," the early portion of these pressure buildup tests (e.g., the first flow period up to time tp) often may be referred to by those of ordinary skill in the art as a "drawdown test."

Referring now to FIG. 7, a build up test generally may be represented mathematically as the summation of two tests (or two wells). One well is a flowing well starting at time $T_0$, the second well is an injection well located at the same point at the first flowing well, however the injection is starting at time $T_p$. The rates of the two wells may be represented as "+q" (for the flowing well) and "−q" (for the injection well).

When the solutions of the two situations illustrated in FIG. 7 are added together, using the mathematical principle known as superposition, the result is illustrated by the graph in FIG. 8. The principle of superposition is applicable to linear partial differential problems with linear boundary and initial conditions. When the superposition in time is performed, the pressure change equation becomes a function of the superposition time. This superposition time is defined in its most general case as $t_p\ \Delta t/(t_p+\Delta t)$. A more concise form is usually used in what is commonly termed a "Homer plot." In a Homer plot the superposition time may be defined as $(t_p+\Delta t)/(\Delta t)$. The graph is logarithmic in time, thus the use of either term should yield the same slope which is used to determine permeability.

Well Bore Evaluation Methods

Figure 28:
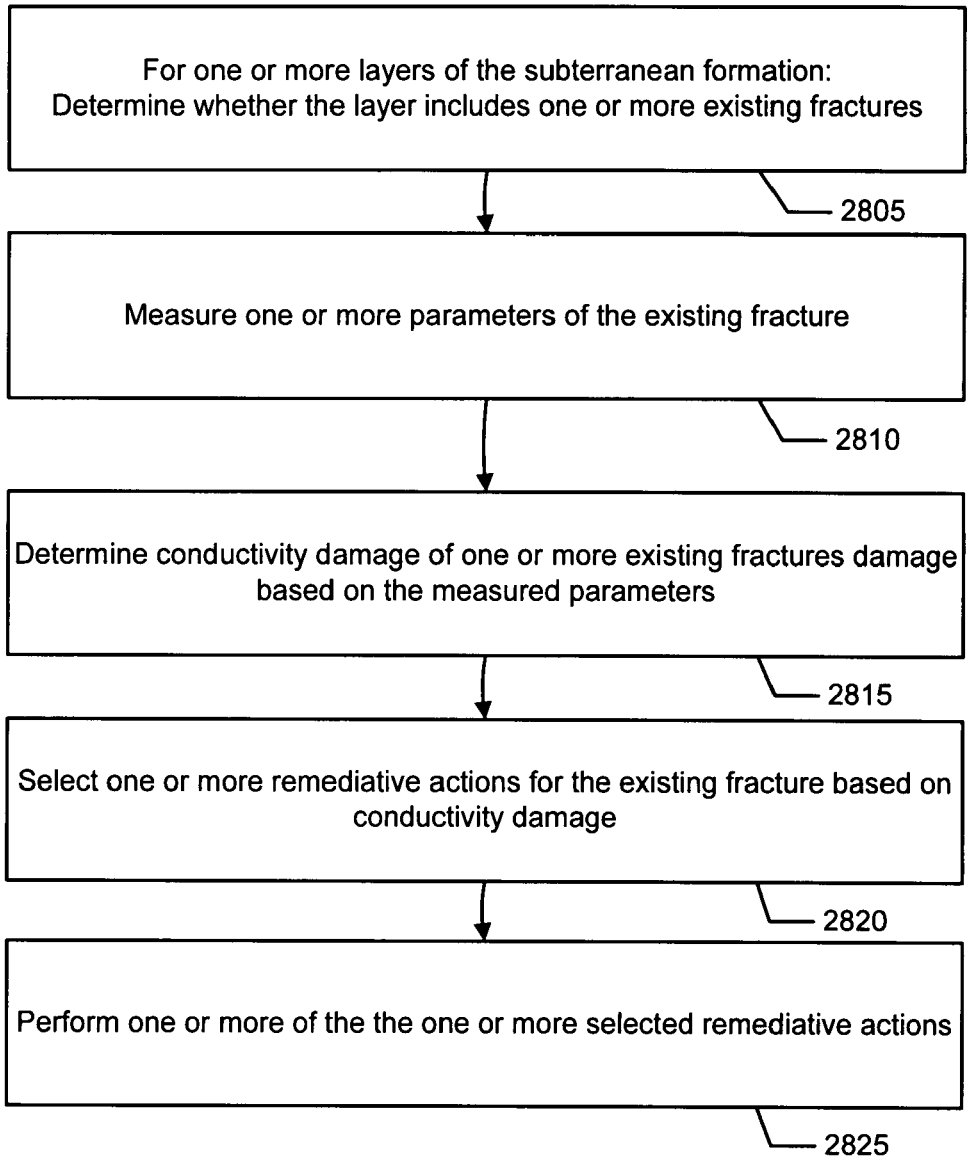
FIG. 28 is a flow chart of an exemplary method of treating a subterranean formation.

FIG. 28 is a flow chart of an example method for evaluating a well bore in a subterranean formation. In certain implementations the method may be performed by a computer that includes one or more processors, a memory, one or more input devices, and one or more output devices. In general, the subterranean formation includes one or more layers. In some example implementations, the existence of fractures in one or more of the layers may be known before the method begins. In other implementations, the existence of existing fractures in layers of the formation may be evaluated by the method. For example, in step 2805, the method includes determining whether one or more of the layers includes one or more existing fractures.

In step 2810, the method includes measuring one or more parameters of the existing fracture. In one example implementation, the measurement of the one or more parameters includes performing one or more shut-in tests in which fluid is injected into the existing formation and shut-in, which the change in pressure in the fracture is measured. In certain example implementations, the fluid is injected into the existing fractures at or below fracturing pressure. In another example implementation, the method includes injecting one or more tracers into the formation and measuring the propagation of the tracers in the existing fracture.

In step 2815, the method includes determining conductivity damage of one or more existing fractures based, at least in part, on the measured parameters of the existing fracture. As will be described in greater detail below, example implementations include determine one or more of a degree of fracture damage and a depth of the fracture damage. In certain example implementations, the determination of the conductivity damage of the existing fracture is also based on one or more known or assumed properties of the existing fracture such as one or more of the total fracture length, fracture location, the fracture orientation. As described below, the determination of conductivity damage may be performed by one or more of curve-fitting or regression testing.

In step 2820, the method includes selecting one or more remediative actions for the existing fracture based, at least in part, on the conductivity damage determined in step 2810. In one example implementation, the selected remediative actions include one or more fracture treatments. Example fracture treatments include, by way of example, one or more of a micro-fracturing treatment, pulsonics, acid washing, organic solvent treatment, sand consolidation, and a full re-fracturing treatment. In one example implementation, the selected remediative actions include one or more reservoir treatments. Example reservoir treatments may include, by way of example, one or more of surfactant treatments, energized fluid treatments, alcohol-injection treatments, and water block treatments. As noted above, the choice of which fracture treatments and reservoir treatments, if any, to use is based at least in part on one or more of the depth of damage and the degree of damage to the existing fracture. For example, if both the degree and depth of damage to the existing fracture are relatively minor, the selected remediation may include fracture clean-up and near-wellbore reservoir treatment. In another example implementation, if the depth of damage is relatively large, but the degree of damage is relatively minor, the selected remediative action may include reservoir treatment. In another example implementation where both the degree and depth of damage to the existing fracture are relatively large, a full refracturing treatment may be performed. In step 2825, the selected remediative action are performed. The remediative actions may be performed by one or more tools that are configured to perform one or more fracturing treatments and by one or more tools that are configured to perform one or more reservoir treatments.

Figure 9:
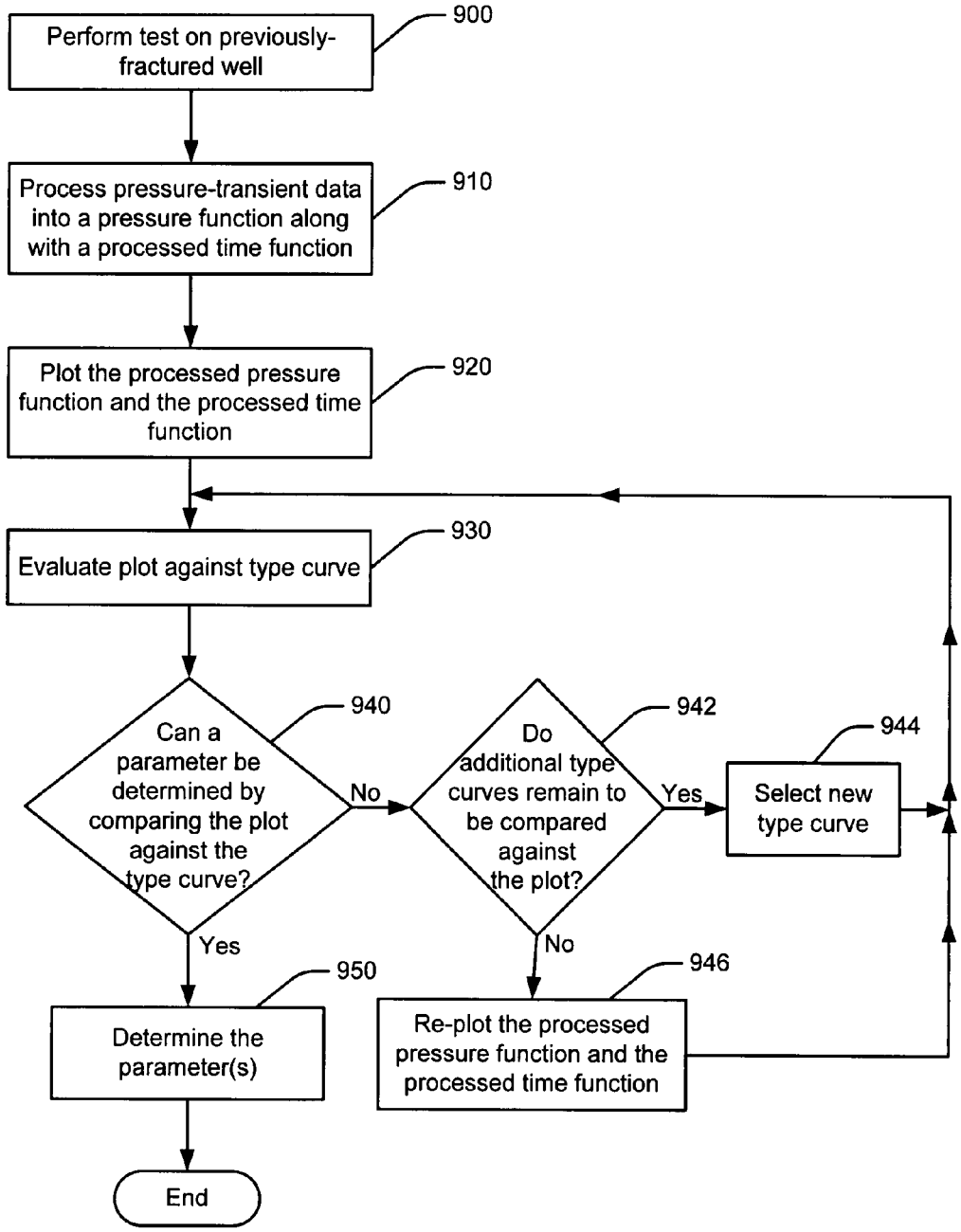
FIG. 9 is a top-level flow chart depicting an exemplary method for evaluating a well bore in accordance with the present disclosure.

FIG. 9 illustrates an exemplary method of evaluating a well bore. In step 900, a well that has been previously fractured is tested. A variety of tests may be performed, including, for example and without limitation: an injection falloff test; a pressure buildup test in which the well is shut in for a period of time during which the ensuing pressure increase is measured; and long-term monitoring of pressure and production rate; and the like. The duration of time that constitutes "long-term" may depend upon a number of factors, including, for example, reservoir properties, fluid properties, and fracture length; for a particular well, one of ordinary skill in the art will be able to determine the length of time to monitor the well so as to perform "long-term" monitoring. In addition to the tests described above, other tests may be performed, as will be recognized by one of ordinary skill in the art, with the benefit of this disclosure.

In step 910, pressure-transient data (which may be in the form of, e.g., a record of the observed pressure as a function of time for the duration of the test performed in step 900) may be processed into a pressure function together with a processed time function. As used herein, the term "processed" will be understood to include, for example, the manipulation of data and the creation of plots or graphs to facilitate evaluation of subterranean conditions. Multiple functions are possible. The pressure function may be merely pressure, change in pressure, conventional pressure derivative $$\left(t\frac{\partial p}{\partial t}\right),$$

prime derivative $$\left(\frac{\partial p}{\partial t}\right),$$

or second derivative $$\left(t^2\frac{\partial^2 p}{\partial t^2}\right).$$

For gas reservoirs, the real gas function may replace the use of pressure. The time function may be, e.g., time, change in time, superposition time, real time function, or the like. Moreover, rate-transient data (e.g., in the form of recorded production rate or cumulative production as a function of time), also may be processed manually or with the help of computer software into a rate function together with the processed time function and plotted. When a rate function is employed, the rate function may be, for example, flow rate, reciprocal of flow rate, the conventional derivative of flow rate $$\left(t\frac{\partial q}{\partial t}\right),$$

the conventional derivative of reciprocal of flow rate $$\left(t\frac{\partial(1/q)}{\partial t}\right),$$

the prime derivative of flow rate or reciprocal of flow rate, the cumulative production (e.g., integration of flowrate over time), and the like. The examples enumerated above are not intended to limit the forms of the pressure, rate, and time functions envisioned by the present disclosure; rather, in certain example implementations, other functions are used, e.g., pseudo pressure function, pseudo time function, rate integral function, pressure integral-derivative function.

In step 920, the chosen functions (e.g., processed pressure function and processed time function) are plotted in Cartesian, semi-log or log-log fashion using an appropriate scale function. Multiple functions may be plotted; for example, in step 920, the chosen functions may be, e.g., change of pressure and conventional pressure derivative.

In step 930, the plot prepared in step 920 is compared against a type curve, or a set of type curves. Among other things, comparing a plot of a processed pressure function and processed time function against one or more type curves may facilitate the determination of fracture parameters (e.g., base conductivity of the fracture, fracture length, degree of damage that may exist, and depth of damage that may exist). As referred to herein, the term "depth of damage" will be understood to mean how far into the fracture damage has occurred. As referred to herein, the term "degree of damage" will be understood to mean how low the fracture conductivity has dropped from its initial value. In certain embodiments, the comparison performed in step 930 may involve matching or analyzing late-time data (e.g., data occurring after the effect of damage has disappeared). In general, the term "late-time data" refers to the infinite acting behavior. In certain example embodiments, including those wherein a fracture is suspected to have been partially damaged, the comparison performed in step 930 may involve matching the full range of the data, and further may involve an emphasis on matching the early time data.

The comparison performed in step 930 may be performed in a variety of ways, including, for example, manual matching of one or more type curves against the plot prepared in step 920, or through the use of regression techniques. An example of manual type curve matching is illustrated in Robert Earlougher, "Advances in Well Test Analysis," SPE Monograph Volume 5 (1977 ed.), at pages 22-30, particularly pages 24-25. The matching process also may be performed by using computer software with type-curve matching capabilities, such as SAPHIR available from Kappa Engineering of Paris, France, and PANSYSTEM available from EPS Limited of Edinburgh, United Kingdom. When type curve matching is to be performed using a computer, such matching may be performed by, for example, the process illustrated in FIG. 10 (further described herein below).

After the plot prepared in step 920 has been compared against one or more type curves in step 930, the process proceeds to step 940, in which a determination is made whether a fracture parameter (e.g., base fracture conductivity, degree of damage, depth of damage, and the like) can be determined by comparing the chosen plot against a chosen type curve(s). If a fracture parameter can be determined, the process proceeds to step 950, in which the parameter is determined, and then the process proceeds to end.

If, however, the determination is made in step 940 that a fracture parameter cannot be determined by comparing the chosen plot against the chosen type curve(s), the process proceeds to step 942, in which a determination is made whether additional type curves remain to be compared against the chosen plot (e.g., the plot prepared in step 920). If additional type curves do remain to be compared against the chosen plot, the process proceeds to step 944, in which one or more new type curves are selected, after which the process returns to step 930, which has been previously described above. If, however, no additional type curves remain to be compared against the chosen plot, the process proceeds to step 946, in which the processed pressure function and the processed time function are re-plotted. For example, if the processed pressure function and the processed time function originally were plotted in Cartesian format in step 920, then in step 946, these functions may be re-plotted in, e.g., semi-log or log-log format. From step 946, the process returns to step 930, which has been previously described above.

In certain preferred embodiments of the present disclosure, the formation permeability will be known, and may be used to aid in determining one or more fracture parameters (e.g., degree of damage and depth of damage). In embodiments wherein the formation permeability is not known, the degree of uncertainty will increase, but the lack of knowledge of formation permeability will not render the raw data of step 900 un-analyzable.

Figure 10:
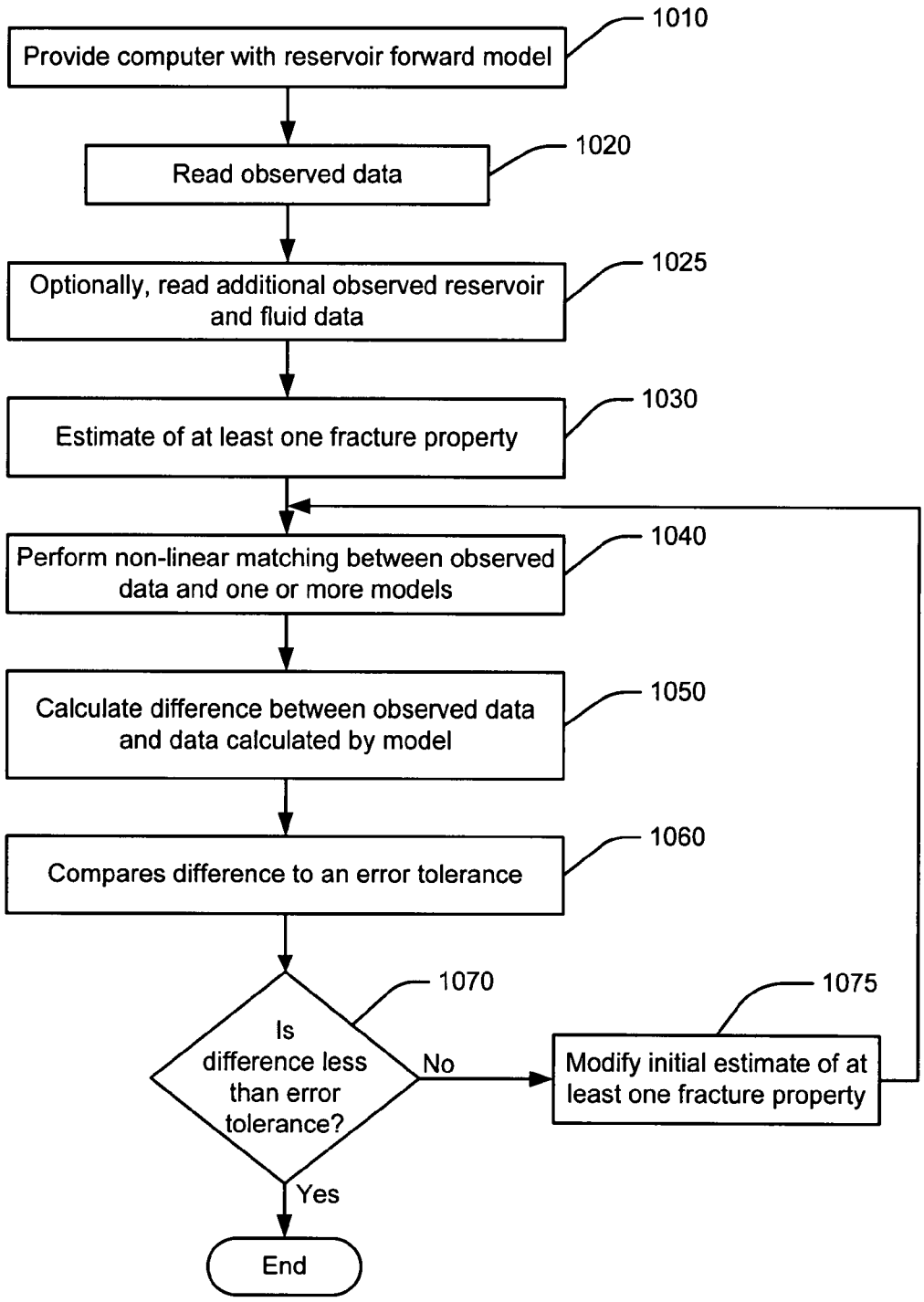
FIG. 10 is a top-level flow chart depicting an exemplary method for performing type curve matching through the use of a computer.

Referring now to FIG. 10, illustrated therein is an exemplary method that may be used to perform type curve matching (such as may be used in step 930 of FIG. 9). In certain example implementations, the curve matching is implemented in a computer that comprises one or more processors and a memory. In step 1010, a reservoir forward model is stored in the computer's memory. In general, a reservoir forward model is used to predict reservoir behavior based on reservoir data and/or fluid data. For example, the computer may have stored in its memory software such as SAPHIR or PANSYSTEM, both of which are capable of being programmed with a reservoir forward model, and also contain a non-linear programming matching program (suitable for use in step 1040, which is described further below). In step 1020, observed data (e.g., pressure versus time) is entered into the regression model. In an optional step 1025, additional observed reservoir and fluid data may be read. In certain example implementations, these additional reservoir and fluid parameters include one or more of formation thickness, formation porosity, formation compressibility, fluid compressibility, and fluid viscosity. In step 1030, an initial estimate is made of at least one fracture property, e.g., fracture length, fracture conductivity, depth of fracture damage, degree of fracture damage, and formation permeability. In certain preferred embodiments, an initial estimate may be made of one or more of the following fracture properties: fracture length, fracture conductivity, depth of fracture damage, and degree of fracture damage. In step 1040, a non-linear programming matching program is run on the computer. The program compares the observed data (e.g., the data read in step 1020 and in optional step 1025) against the data calculated by the reservoir forward model. In step 1050, the matching program will calculate the difference between the observed data and the data calculated by the reservoir forward model. In step 1060, the difference calculated in step 1050 will be compared to an error tolerance. In step 1070, a determination is made whether the difference calculated in step 1050 is less than the error tolerance. If the answer to the determination in step 1070 is yes, then the process proceeds to end. If, however, the answer to the determination in step 1070 is no, then the process proceeds to step 1075, wherein the program modifies the initial estimate of the fracture parameters, after which the process returns to step 1040, which has been previously described herein.

To facilitate a better understanding of the present disclosure, the following example embodiments are provided. In no way should such examples be read to limit, or to define, the scope of the invention.

EXAMPLE 1

Figure 11:
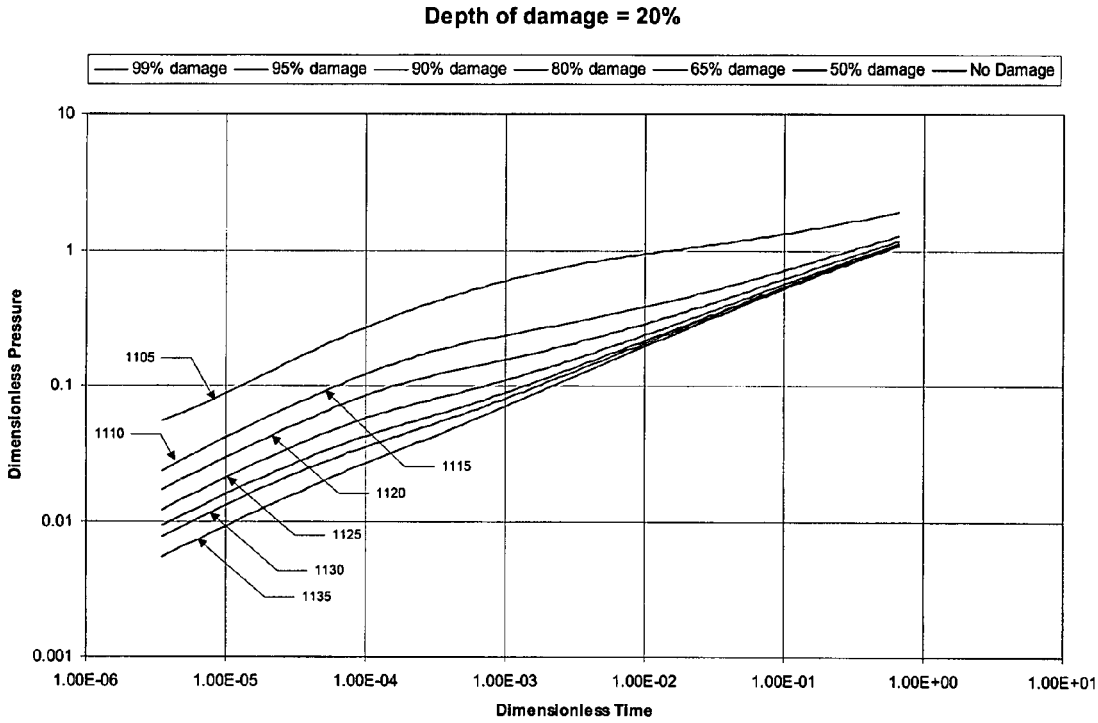
FIG. 11 is an exemplary set of type curves depicting the effect of a 20% reduction in conductivity in an exemplary fracture near an exemplary simulated well bore.
Figure 12:
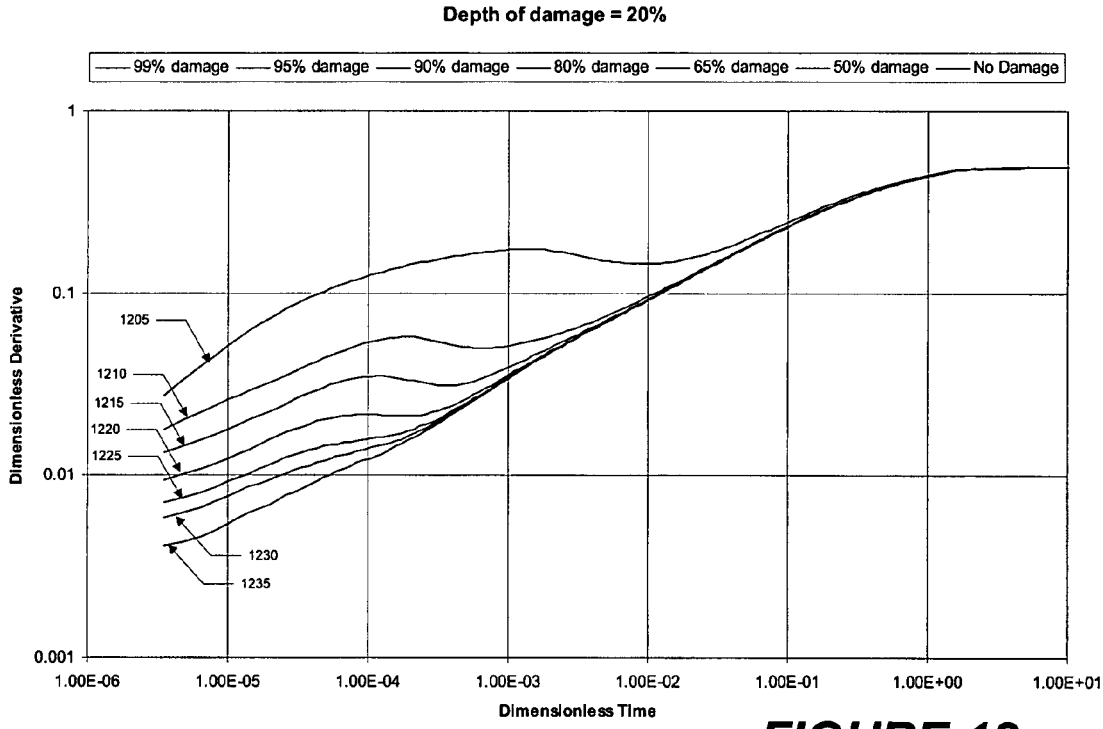
FIG. 12 is another exemplary set of type curves depicting the effect of a 20% reduction in conductivity in an exemplary fracture near an exemplary simulated well bore.

Example 1 presents three exemplary sets of type curves generated for simulated well bores to illustrate the effects. FIGS. 11 and 12 are sets of type curves that illustrate the effect of a 20% reduction in conductivity of the nearest 10% of the length of a fracture near a simulated wellbore.

In the Figures below, the term "Dimensionless Derivative" that appears on the y-axis is defined as $$t_D \frac{\partial p_D}{\partial t_D}.$$

Dimensionless Prime Derivative is defined as $$\frac{\partial p_D}{\partial t_D}.$$

Though both dimensionless derivative and dimensionless prime derivative illustrate the slope of a change of pressure with time, it will be noted that the dimensionless derivative is scaled using time. Derivative plots are useful for a variety of reasons, including, for example, the fact that they exaggerate the change in pressure with time, thus facilitating diagnosis of problems with fractured wells.

Figure 13:
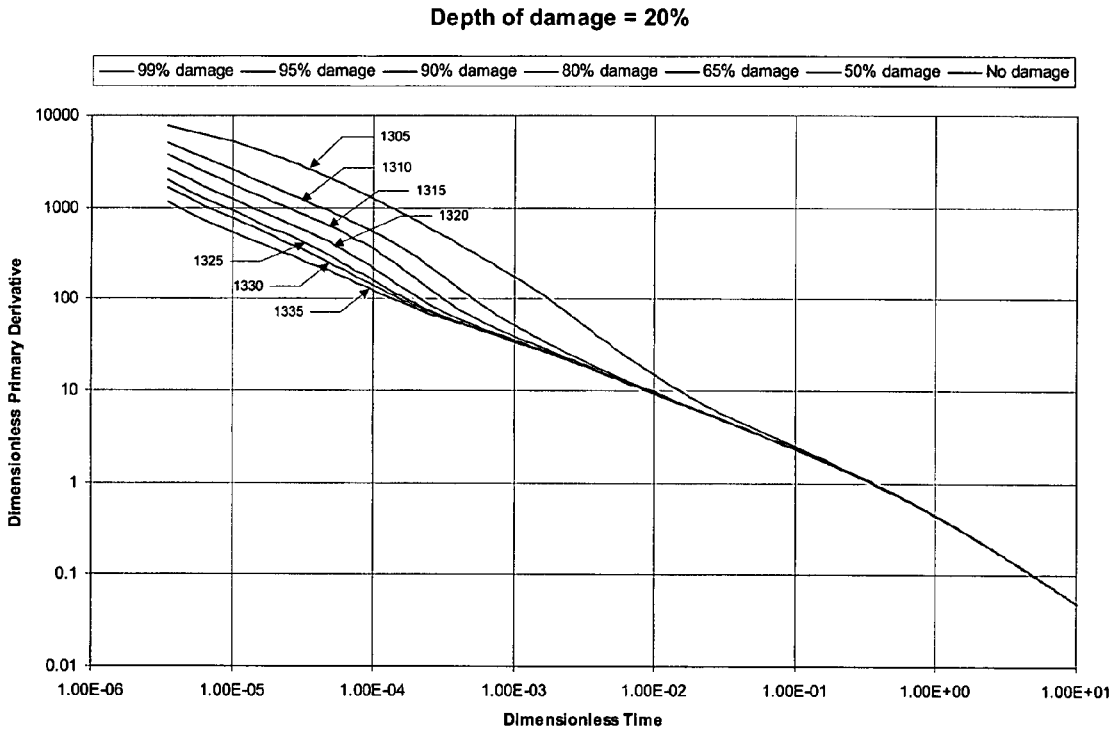
FIG. 13 is still another exemplary set of type curves depicting the effect of a 20% reduction in conductivity in an exemplary fracture near an exemplary simulated well bore.

FIG. 11 is a plot of dimensionless pressure versus dimensionless time. FIG. 12 is a plot of dimensionless derivative versus dimensionless time. FIG. 13 is a set of type curves that illustrates the effect of reduction in conductivity on the primary derivative plot, e.g., the slope of the pressure plot, $\partial p/\partial t$. In FIGS. 11-13, it will be understood that each curve represents a degree of damage for a fracture with an original fracture conductivity ($C_{fD}$) of 50. In FIGS. 11-13, curves 1105, 1205, and 1305 represents 99% damage; curves 1110, 1210, and 1310 represents 95% damage; curves 1115, 1215, and 1315 represents 90% damage; curves 1120, 1220, and 1320 represents 80% damage; curves 1125, 1225, and 1325 represent 65% damage; curves 1130, 1230, and 1330 represent 50% damage; and curves 1135, 1235, and 1335 represent no damage. Type curves, such as those shown in FIGS. 11-13 are used for comparison with measured data to determine one or more reservoir parameters, such as one or more of degree of fracture damage or depth of fracture damage.

In FIGS. 11-13, the original dimensionless fracture conductivity ($C_{fD}$) is 50. These Figures illustrate that, for the simulated well, the loss of conductivity will not become significant until it exceeds 50% of the original conductivity; e.g., for the simulated well, the degree of damage must exceed 50% of $C_{fD}$ for it to become significant. Moreover, FIGS. 11-13 also demonstrate that if the loss in conductivity is high (e.g., greater than about 50% of the original conductivity, in many circumstances), then the pressure data will show a deviation from the undamaged fractured well behavior to determine the depth and degree of damage. In many actual damaged fractures, the degree of damage is in at or about of 90%, which would curtail production.

FIGS. 11-13 also show that significant damage of fracture conductivity near the wellbore will have a significant effect on well performance. They also show that the depth of damage and degree of damage of fracture conductivity are detectable by carefully testing the well.

EXAMPLE 2

Example 2 presents eight additional exemplary sets of type curves generated for simulated well bores. For FIGS. 14-21, curves 1405, 1505, 1605, 1705, 1805, 1905, 2005, and 2105 represent 50% depth of damage to the existing fracture; curves 1410, 1510, 1610, 1710, 1810, 1910, 2010, and 2110 represent 30% depth of damage to the existing fracture; curves 1415, 1515, 1615, 1715, 1815, 1915, 2015, and 2115 represent 20% depth of damage to the existing fracture; curves 1420, 1520, 1620, 1720, 1820, 1920, 2020, and 2120 represent 10% depth of damage to the existing fracture; curves 1425, 1525, 1625, 1725, 1825, 1925, 2025, and 2125 represent 5% depth of damage to the existing fracture; curves 1430, 1530, 1630, 1730, 1830, 1930, 2030, and 2130 represent 1% depth of damage to the existing fracture; curves 1435, 1535, 1635, 1735, 1835, 1935, 2035, and 2135 represent no depth of damage to the existing fracture. In general, depth of damage is the location of damage to a fracture as a ratio of the total length of the fracture. FIGS. 14, 16, 18, and 20 are plots of dimensionless pressure versus dimensionless time for existing fractures with original fracture conductivities ($C_{fD}$) of 100, 50, 10, and 2, respectively. FIGS. 15, 17, 19, and 21 are plots of dimensionless derivative versus dimensionless time for existing fractures with original fracture conductivities ($C_{fD}$) of 100, 50, 10, and 2, respectively.

The sets of type curves presented and referenced in Example 2 illustrate the effect of the depth of fracture damage on well performance. The sets of type curves for Example 2 were generated for a simulated well bore having 90% damage to the existing fracture. As will be seen, the original dimensionless fracture conductivity has a very strong effect on the shape of the data. To further illustrate this behavior, type curves are presented that show the effect of depth of damage for dimensionless fracture conductivities ranging from 100, 50, 10 and 2.

Figure 14:
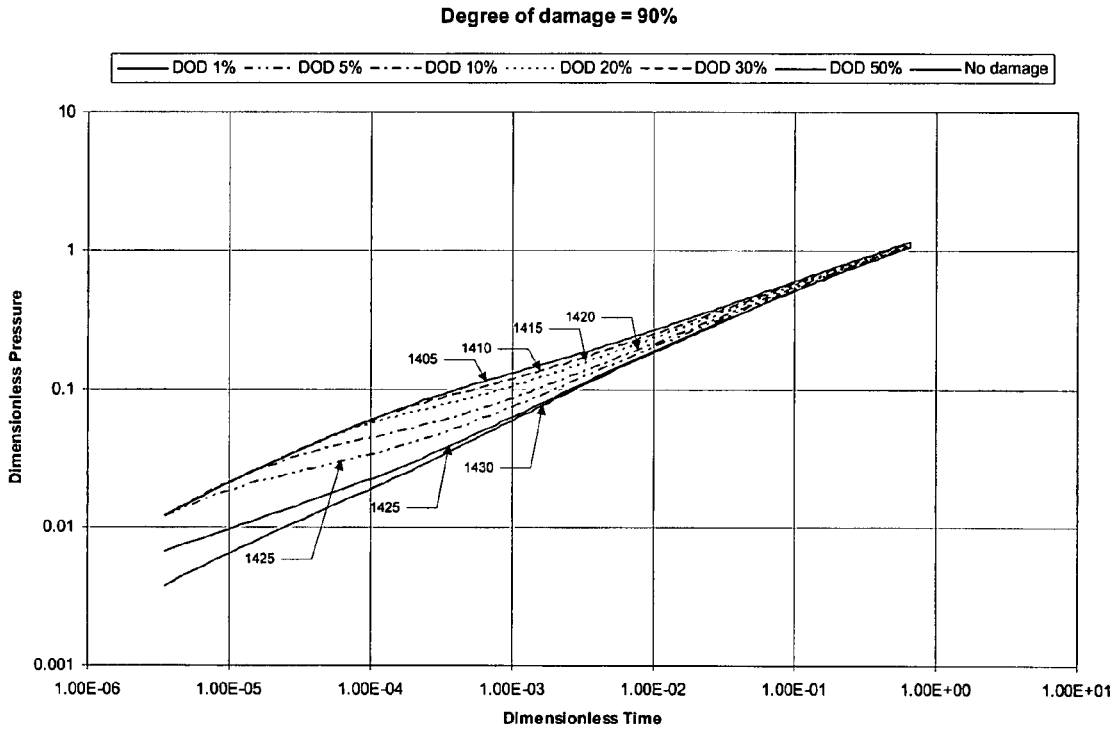
FIG. 14 is an exemplary set of type curves depicting the effect of a 90% reduction in conductivity of an exemplary fracture for an exemplary simulated well bore, the exemplary fracture having an original dimensionless fracture conductivity of 100.
Figure 15:
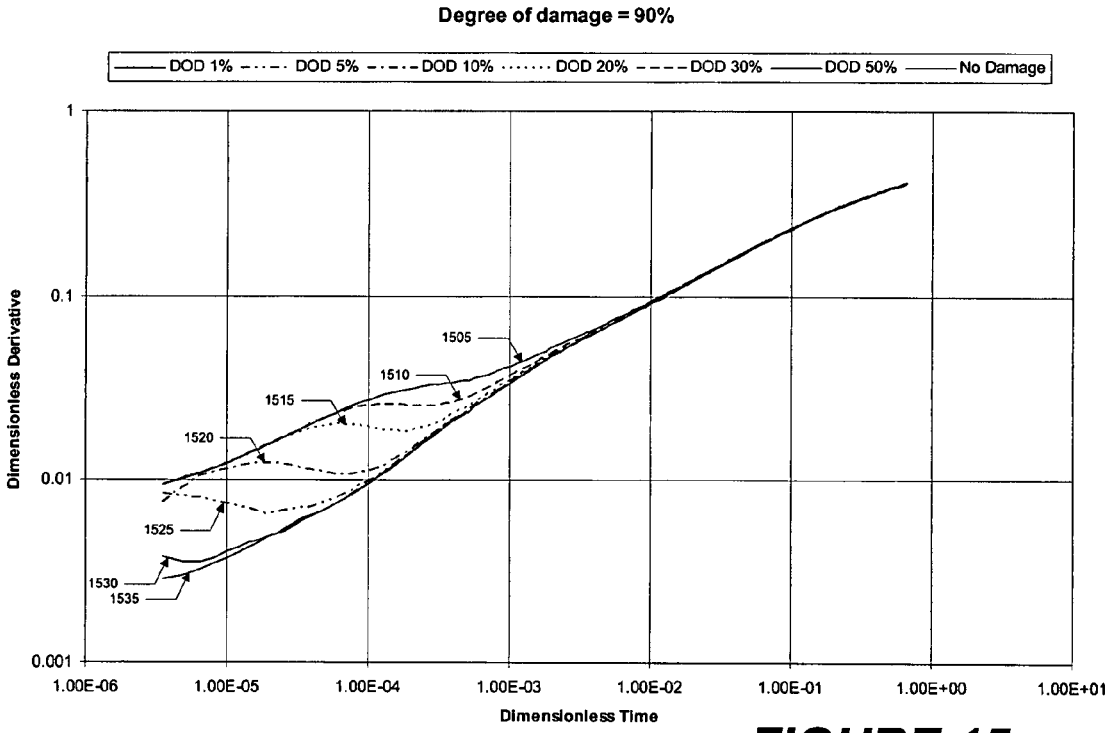
FIG. 15 is another exemplary set of type curves depicting the effect of a 90% reduction in conductivity of an exemplary fracture for an exemplary simulated well bore, the exemplary fracture having an original dimensionless fracture conductivity of 100.

FIGS. 14 and 15 show the effect of depth of damage on the pressure and derivative plots when the degree of damage is 90%, for an exemplary simulated well having an original dimensionless fracture conductivity of 100. FIGS. 14-15 show that the early time behavior of the fracture will behave as if the fracture conductivity is uniform and having lower conductivity. In this case it is only 10% of the original conductivity, e.g., $C_{fD}$=10. Over time, the fracture behavior will shift towards the behavior of the higher conductivity fracture.

The derivative plot, FIG. 15, shows that derivative plot for the damaged fracture will join the derivative plot for the undamaged plot. The pressure plot, however, (FIG. 14) shows there is an additional pressure drop to overcome the extra friction created by the damage. This extra pressure drop may be considered as skin. The additional pressure drop, however, is different from the usual skin factor definition because it does not result from a sink/source term and it does change well behavior over several cycles of time. A conventional skin factor shifts data by a constant value. As referred to herein, the term "skin" will be understood to include one or more of damage on the face of the fracture and damage at the mouth of the fracture. Skin generally does not have a thickness or volume, and generally behaves as a pressure sink.

In this Example, because of the high original fracture conductivity (e.g., for Example 2 the original $C_{fD}$ value was assumed to be 100), a sufficient level of fracture conductivity still will remain even after a loss of 90% of conductivity. In addition, the derivative plot depicted in FIG. 15 shows that it may be difficult to identify the effect of damage after a dimensionless time of 0.005 because the difference between the curves becomes insignificant. It is expected that this situation will change as the $C_{fD}$ decreases.

Figure 16:
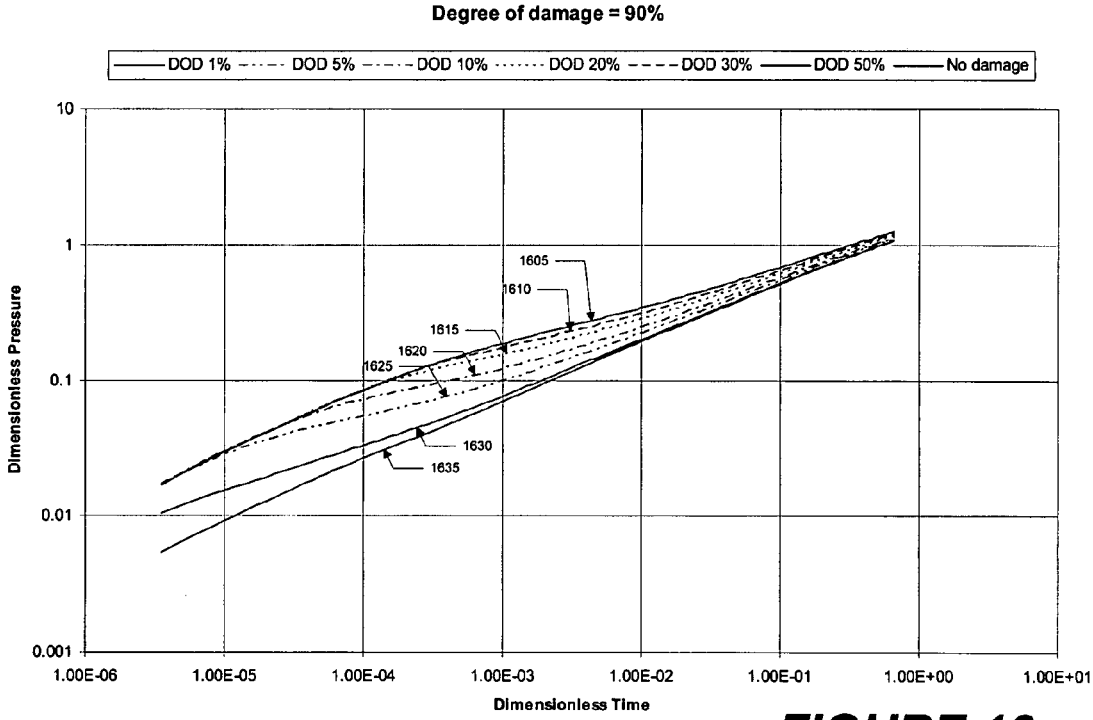
FIG. 16 is an exemplary set of type curves depicting the effect of a 90% reduction in conductivity of an exemplary fracture for an exemplary simulated well bore, the exemplary fracture having an original dimensionless fracture conductivity of 50.
Figure 17:
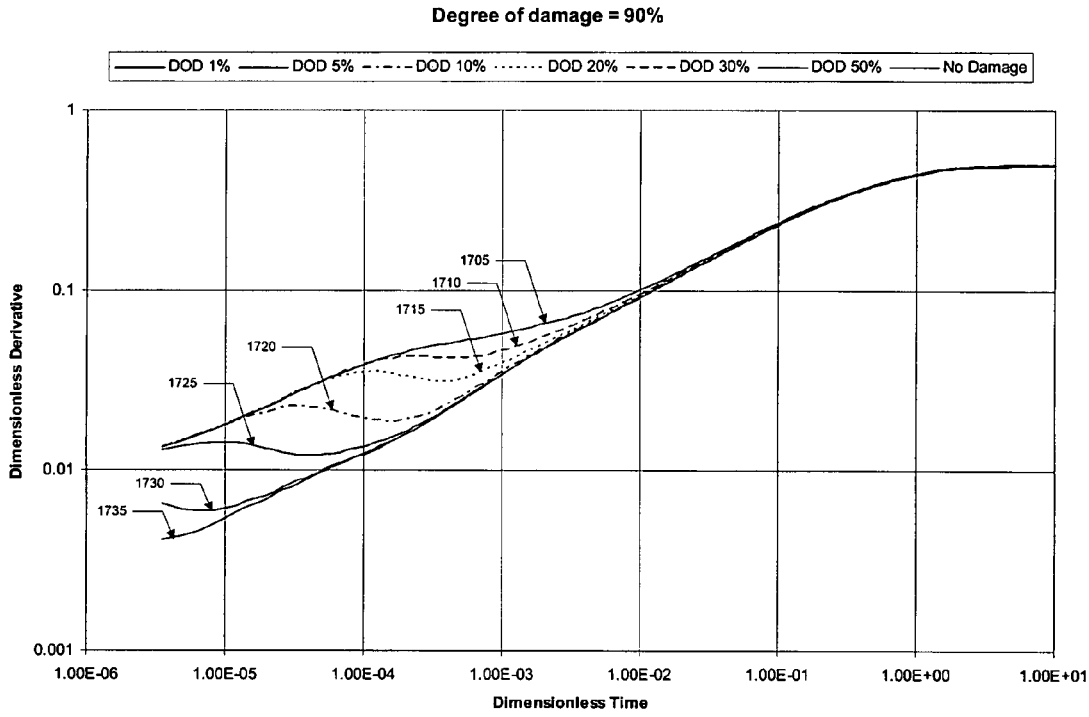
FIG. 17 is another exemplary set of type curves depicting the effect of a 90% reduction in conductivity of an exemplary fracture for an exemplary simulated well bore, the exemplary fracture having an original dimensionless fracture conductivity of 50.

FIGS. 16 and 17 show the effect of depth of damage on the pressure and derivative plots when the degree of damage is 90%, for an exemplary simulated well having an original dimensionless fracture conductivity of 50. FIGS. 16-17 show that the early time behavior of the fracture will behave as if the fracture conductivity is uniform and having the lower conductivity. In this case, because the fracture has suffered 90% damage, the conductivity now is only 10% of the original dimensionless fracture conductivity of 50, e.g., $C_{fD}$ now equals 5. By comparing FIG. 16 to FIG. 14, it may be observed that 90% damage to the fracture has a more significant effect on reservoir performance when the original dimensionless fracture conductivity is only 50 (e.g., FIG. 16) than when the original dimensionless fracture conductivity is 100 (e.g., FIG. 14).

As the original dimensionless fracture conductivity declines, the effect of damage to the fracture becomes more pronounced. FIGS. 18-21 show the effect of damage for original dimensionless fracture conductivity ($C_{fD}$) of 10 and 2.

Figure 18:
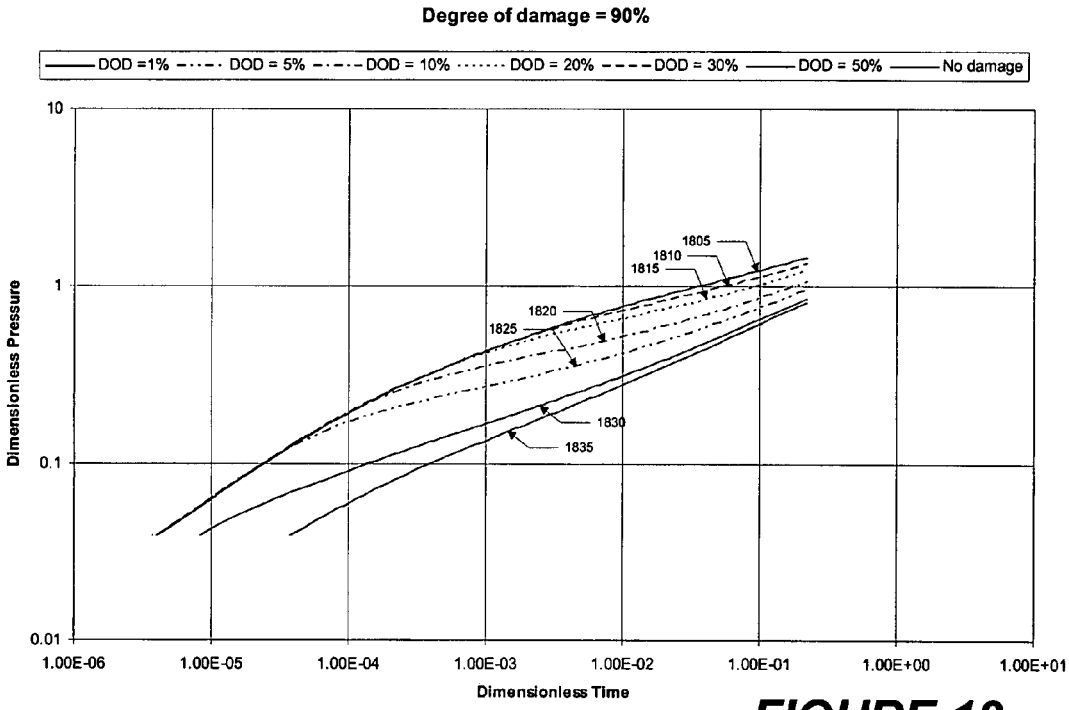
FIG. 18 is an exemplary set of type curves depicting the effect of a 90% reduction in conductivity of an exemplary fracture for an exemplary simulated well bore, the exemplary fracture having an original dimensionless fracture conductivity of 10.
Figure 19:
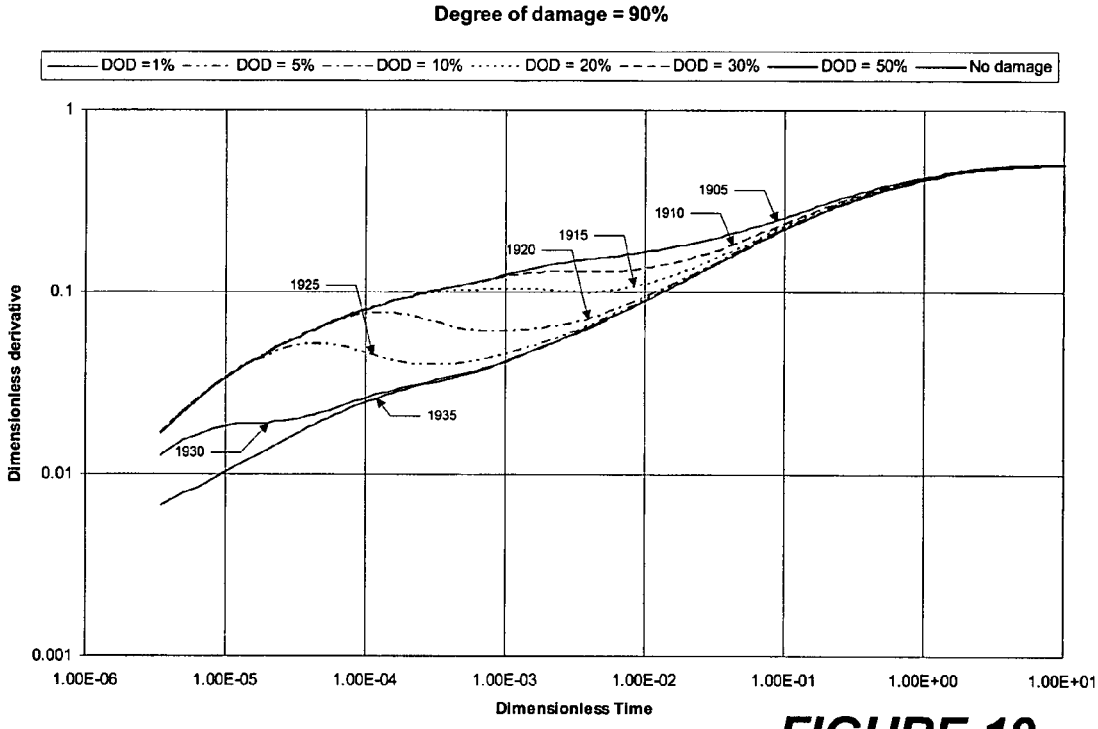
FIG. 19 is another exemplary set of type curves depicting the effect of a 90% reduction in conductivity of an exemplary fracture for an exemplary simulated well bore, the exemplary fracture having an original dimensionless fracture conductivity of 10.
Figure 20:
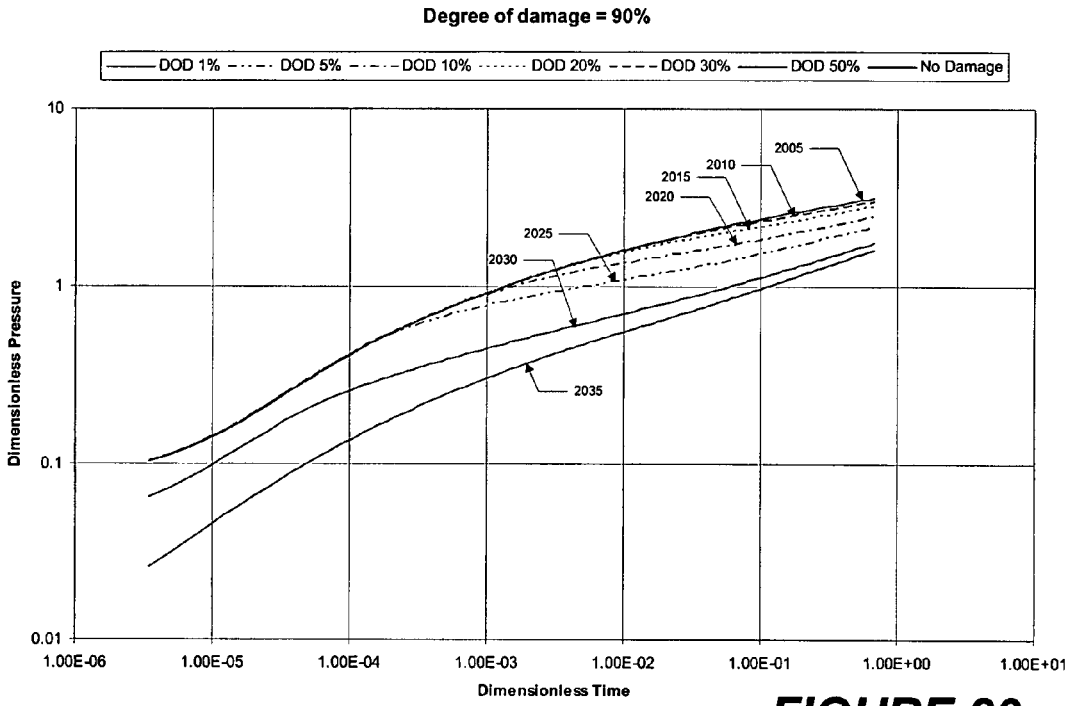
FIG. 20 is an exemplary set of type curves depicting the effect of a 90% reduction in conductivity of an exemplary fracture for an exemplary simulated well bore, the exemplary fracture having an original dimensionless fracture conductivity of 2.
Figure 21:
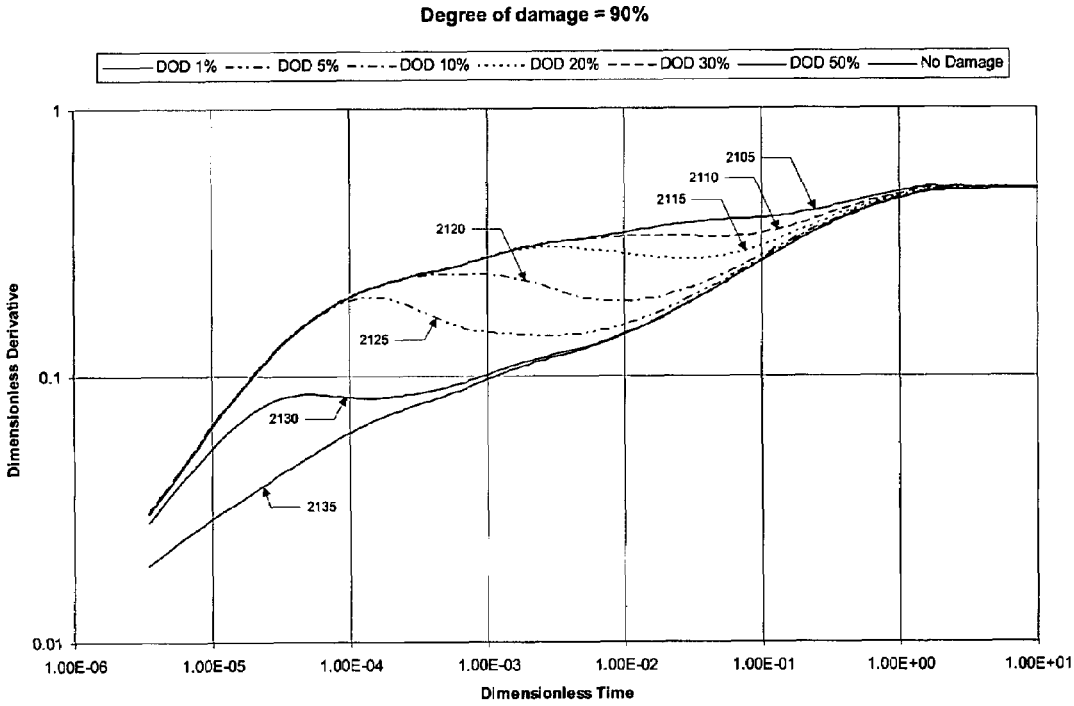
FIG. 21 is another exemplary set of type curves depicting the effect of a 90% reduction in conductivity of an exemplary fracture for an exemplary simulated well bore, the exemplary fracture having an original dimensionless fracture conductivity of 2.

FIGS. 18 and 19 show the severe effect of damage will have on fractured well performance when the original dimensionless fracture conductivity is low. FIG. 20 indicates that for the low dimensionless fracture conductivity of 2, the damage near the fracture mouth may require the pressure drop to increase, sometimes significantly, for the fractured well to produce the same amount of fluid.

FIGS. 11-13 from Example 1 and FIGS. 14-21 from Example 2 illustrate, inter alia, the importance of avoiding damaging the fracture conductivity near the wellbore. Near-well-bore fracture damage may be avoided by, inter alia, taking care to ensure that the initial fracturing treatment is tailed in by higher concentration and/or proppant. As used herein, the term "tailed in" will be understood to mean including an amount of larger and/or stronger proppant at the end of the treatment providing higher conductivity and or resistance to crushing.

EXAMPLE 3

Example 3 presents five sets of exemplary type curves generated for simulated well bores, which may be used in accordance with the present disclosure. FIGS. 22-26 were generated for a simulated well bore having a constant pressure boundary. Among other things, Example 3 may be particularly applicable for a gas reservoir. In contrast, a constant-rate-solution may be more suitable for the analysis of pressure drawdown and buildup tests.

Figure 22:
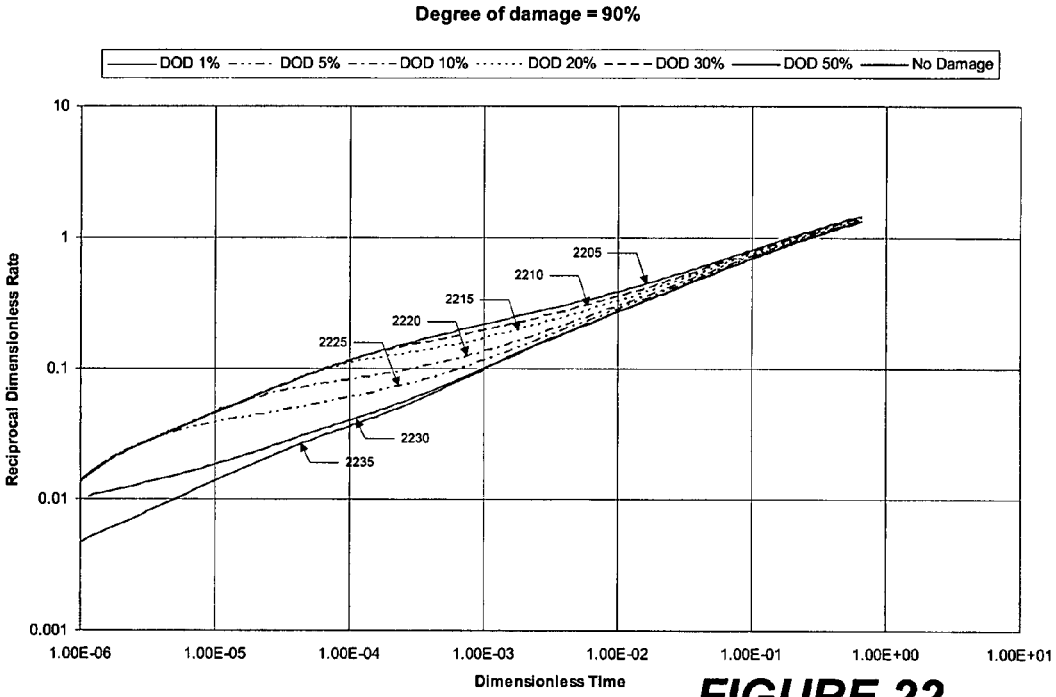
FIG. 22 is an exemplary set of type curves depicting the effect of a 90% reduction in conductivity for an exemplary simulated well bore having a constant pressure boundary, the exemplary fracture having an original dimensionless fracture conductivity of 50.
Figure 23:
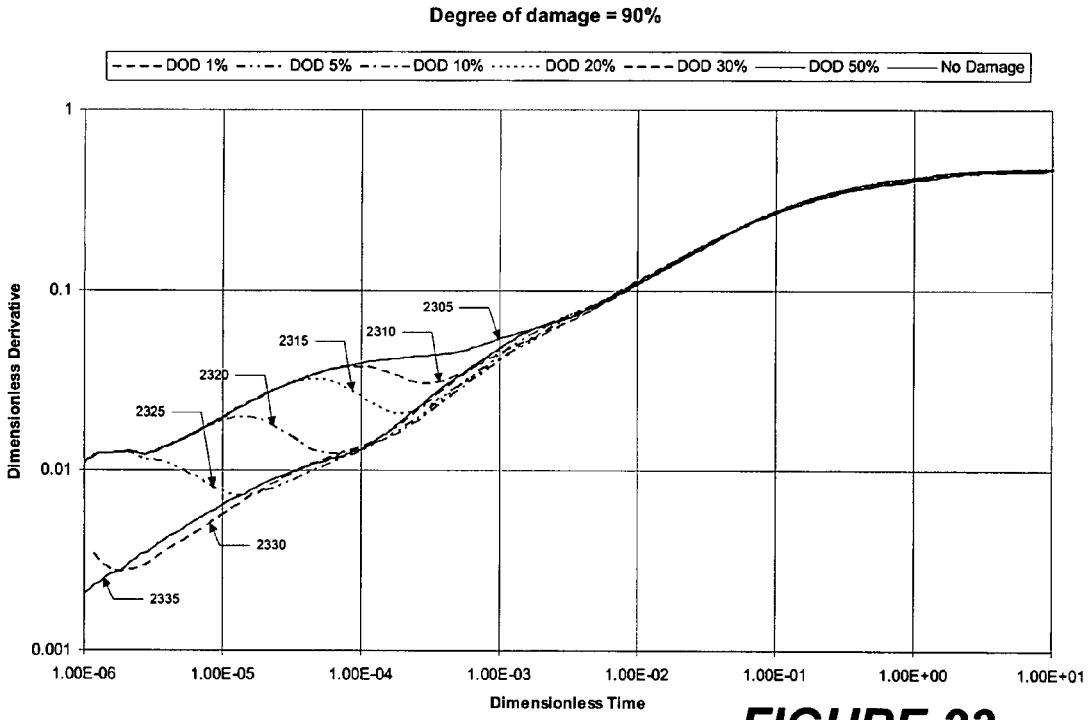
FIG. 23 is another exemplary set of type curves depicting the effect of a 90% reduction in conductivity at the mouth of an exemplary fracture for an exemplary simulated well bore having a constant pressure boundary, the exemplary fracture having an original dimensionless fracture conductivity of 50.
Figure 24:
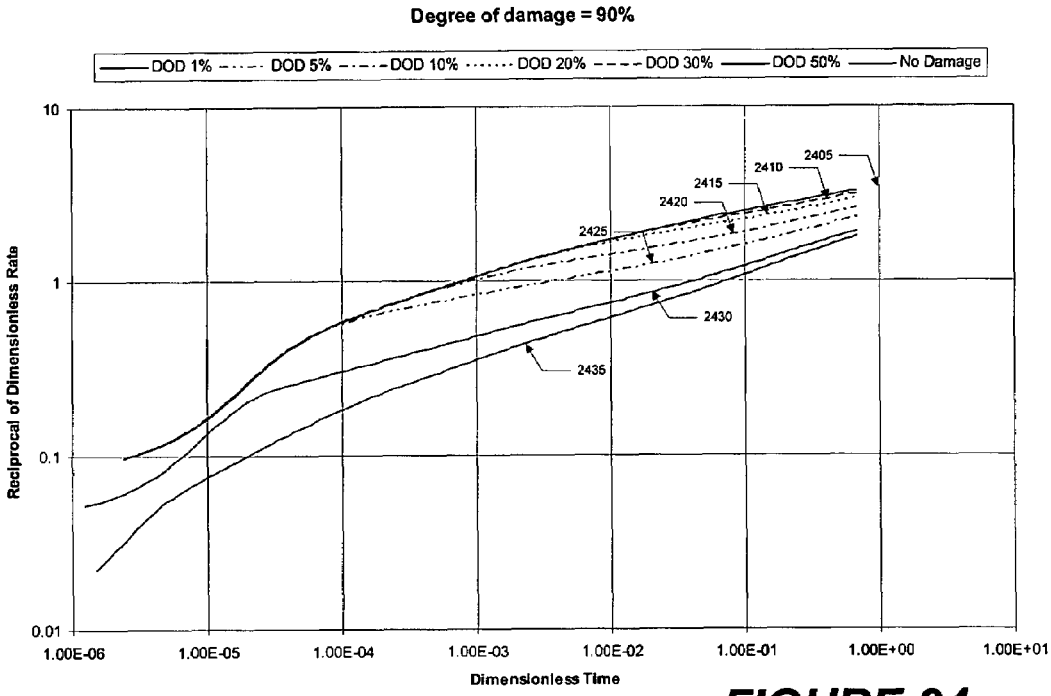
FIG. 24 is an exemplary set of type curves depicting the effect of a 90% reduction in conductivity at the mouth of an exemplary fracture for an exemplary simulated well bore having a constant pressure boundary, the exemplary fracture having an original dimensionless fracture conductivity of 2.
Figure 25:
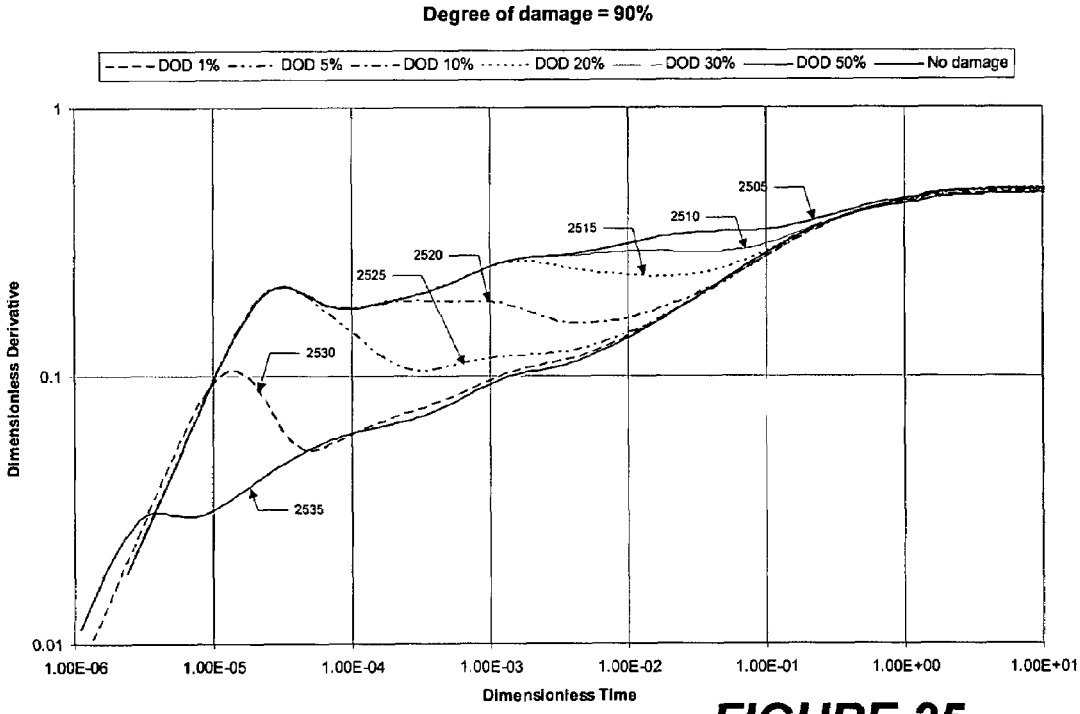
FIG. 25 is another exemplary set of type curves depicting the effect of a 90% reduction in conductivity in an exemplary fracture for an exemplary simulated well bore having a constant pressure boundary, the exemplary fracture having an original dimensionless fracture conductivity of 2.

In FIGS. 22-25, curves 2205, 2305, 2405, 2505, and 2605 represent 50% depth of damage to the existing fracture; curves 2210, 2310, 2410, 2510, and 2610 represent 30% depth of damage to the existing fracture; curves 2215, 2315, 2415, 2515, and 2615 represent 20% depth of damage to the existing fracture; curves 2220, 2320, 2420, 2520, and 2620 represent 10% depth of damage to the existing fracture; curves 2225, 2325, 2425, 2525, and 2625 represent 5% depth of damage to the existing fracture; curves 2230, 2330, 2430, 2530, and 2630 represent 1% depth of damage to the existing fracture; and curves 2235, 2335, 2435, 2535, and 2635 represent no depth of damage to the existing fracture. FIGS. 22 and 24 are plots of the reciprocal dimensionless rate versus dimensionless time for existing fractures with original fracture conductivities of 50 and 2, respectively. FIGS. 23 and 25 are plots of dimensionless derivative versus dimensionless time for existing fractures with original fracture conductivities of 50 and 2, respectively. Accordingly, the plots resemble plots that are generated in a constant rate case.

FIGS. 22-25 illustrate, inter alia, that a reduction in conductivity near the wellbore adversely impacts well performance significantly. An examination of the area under the curves illustrates the extent to which a damaged fracture may affect the productivity of the well and the total production.

EXAMPLE 4

Figure 4:
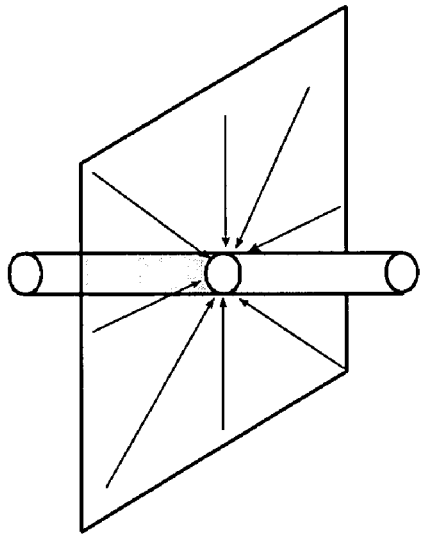
FIG. 4 PRIOR ART
FIG. 4 depicts an exemplary view of the convergence of fluid inside an exemplary transverse fracture intersecting an exemplary horizontal well bore.
Figure 5:
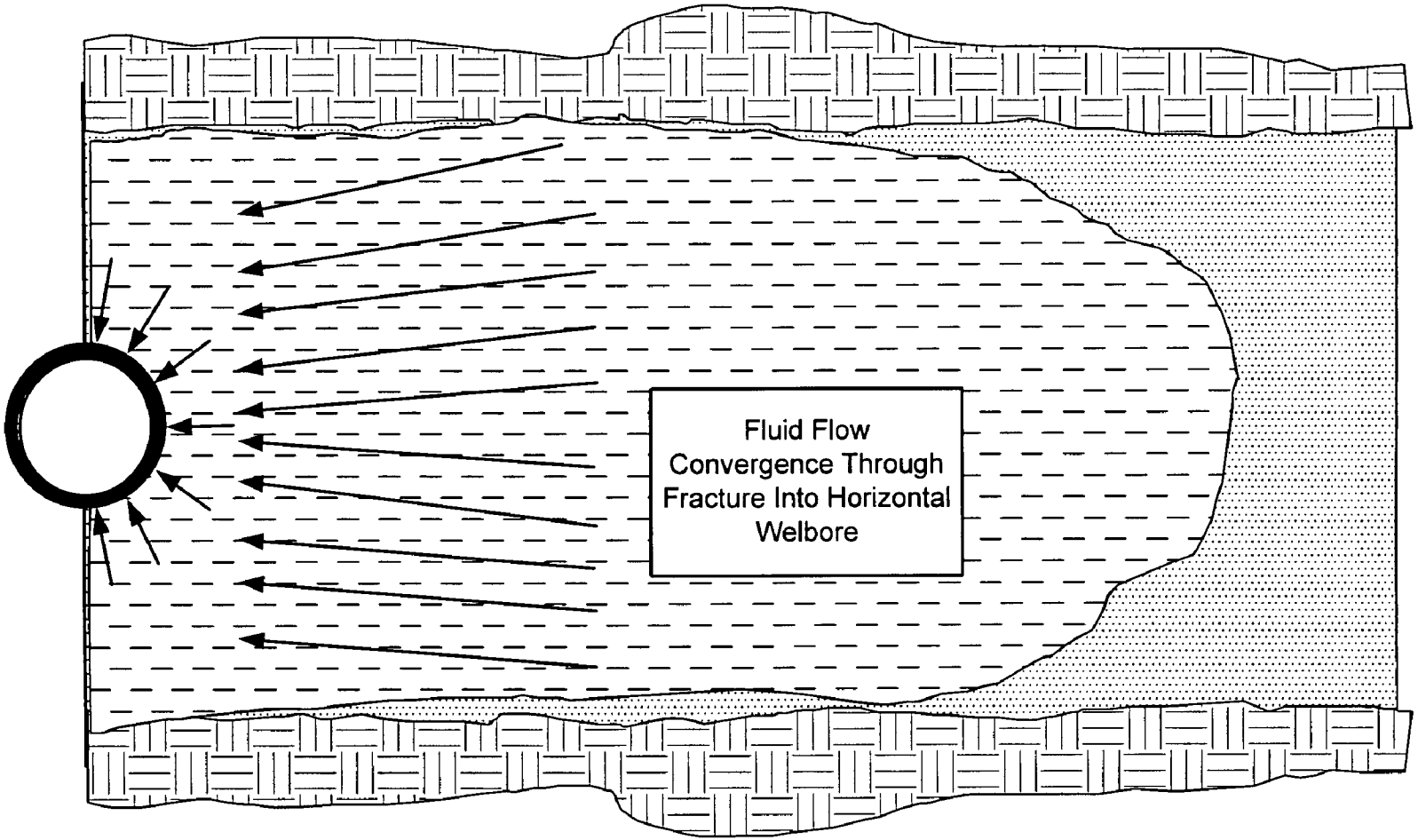
FIG. 5 PRIOR ART
FIG. 5 depicts another exemplary view of the convergence of fluid inside an exemplary transverse fracture intersecting an exemplary horizontal well bore.
Figure 26:
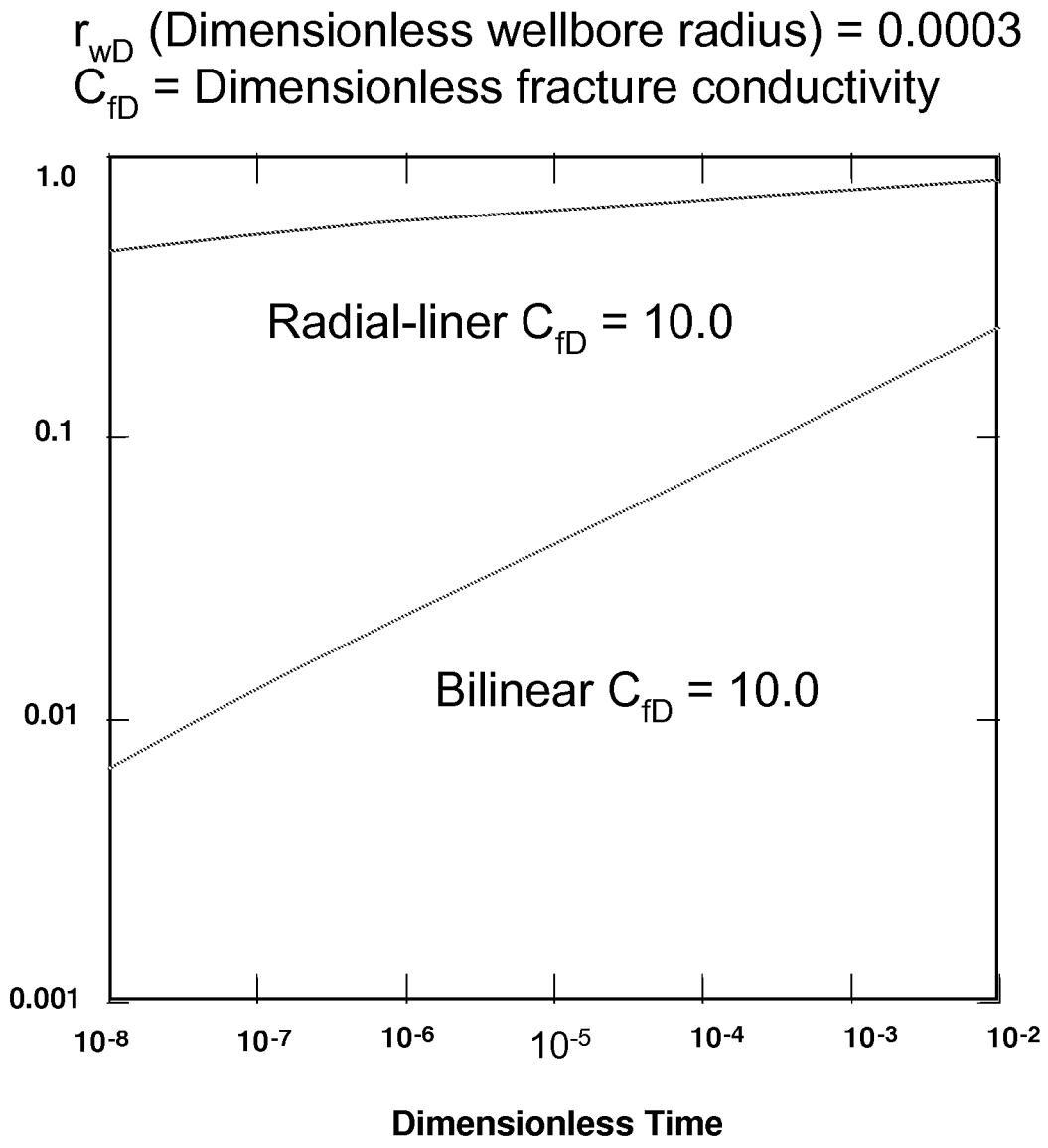
FIG. 26 is a graph of dimensionless pressure versus dimensionless time for a simulated well bore.

Example 4 addresses the impact of near-wellbore conductivity damage in the case of previously-fractured horizontal wells. It may be expected that the effect of fracture conductivity damage may be more pronounced. As noted earlier, transverse fractures in a horizontal well differ from a vertically fractured well, in that the fluid in the fracture for a horizontal well must converge radially toward the wellbore (as shown in FIGS. 4 and 5). As a result, an additional pressure drop is a significant consideration in predicting production performance. This effect may cause the transverse fracture to be less effective than a fracture intersecting a vertical well with a comparable conductivity. FIG. 26 illustrates this concept, where radial-linear flow requires higher pressure drop than the bilinear flow. FIG. 26 shows that the difference between the two regimes will decline over time and as dimensionless conductivity increases. The two flow regimes are identical for infinite conductivity fractures. This indicates that transverse fractures are not recommended for higher permeability formations unless this severe pressure drop around the well is reduced. This also means that loss of fracture conductivity near the wellbore will have a very severe effect on the fractured well performance.

The high pressure drop that usually occurs around the transverse opening can be counteracted during the pumping stage of a hydraulic fracturing operation by using a high conductivity "tail-in" proppant. The tail-in radius, the radial distance from bore hole that the tail-in proppant extends into the fracture, directly affects the pressure drop within the transverse fracture. The benefits of placing a high conductivity tail-in proppant as far in the formation as possible are realized not only in increased well productivity, but also in ease of cleanup after a hydraulic fracture.

Flow regimes encountered after creating transverse hydraulic fractures may include the following flow regimes: linear-radial, formation-linear, compound linear and finally pseudo-radial flow regimes.

Example 4 shows that a high conductivity tail-in may be incorporated to overcome the additional pressure drop caused by fluid convergence around the wellbore. Example 4 also shows that a transverse fracture with low dimensionless conductivity may not be effective. This radial linear flow regime may last for several months, and therefore late time behavior must be also accounted for when selecting a remediative action.

As discussed above with respect to FIG. 28, after conductivity damage to one or more of the existing fractures is determined, the system may then select one or more remediative actions for the existing fracture (step 2820). In certain example implementations, based on the determined conductivity damage, the system may determine that no remediative action is necessary or appropriate for the existing fracture.

Some example implementations include the restoration of near-wellbore conductivity. In some example implementations, this may be accomplished by isolating the interval with a mechanical packer system and then pumping a proppant slurry into the interval to replace or augment the existing proppant pack in the existing fracture. Other techniques would incorporate slurry systems that may precede the proppant slurry to flush or dissolve the suspected fines blocking the near-wellbore conductivity and consolidate them away from the near-wellbore to prevent future migration and damage. Other example implementations for placement may rely on the proppant slurry packing individual perforations and causing diversion to other perforations in a continuous operation that is often referred to as a water pack. Other implementations may include re-perforating the existing interval.

Therefore, the present disclosure is well-adapted to carry out the objects and attain the ends and advantages mentioned as well as those which are inherent therein. While the invention has been depicted, described, and is defined by reference to exemplary embodiments of the invention, such a reference does not imply a limitation on the invention, and no such limitation is to be inferred. The invention is capable of considerable modification, alternation, and equivalents in form and function, as will occur to those ordinarily skilled in the pertinent arts and having the benefit of this disclosure. The depicted and described embodiments of the invention are exemplary only, and are not exhaustive of the scope of the invention. Consequently, the invention is intended to be limited only by the spirit and scope of the appended claims, giving full cognizance to equivalents in all respects.

We claim:

1. A method for treating a subterranean formation, the subterranean formation comprising one or more layers, the method comprising:

for one or more of the layers, determining whether there are one or more existing fractures in the layer, wherein the one or more layers are in a subterranean formation;

for one or more of the one or more existing fractures:

measuring, with a sensor, one or more parameters of the existing fracture;

determining conductivity damage to the existing fracture, based, at least in part, on one or more of the measured parameters of the existing fracture; and selecting one or more remediative actions for the existing fracture, based, at least in part, on the conductivity damage.

2. The method of claim 1, wherein measuring one or more parameters of the existing fracture, comprises:

injecting fluid into the existing fracture and shutting-in the existing fracture; and measuring a resulting pressure change.

3. The method of claim 2, wherein the fluid is injected into the existing fracture at a pressure that is less than a fracturing pressure for the existing fracture.

4. The method of claim 1, wherein determining conductivity damage to the existing fracture, based, at least in part, on one or more of the measured parameters of the existing fracture, comprises:

determining a degree and a depth of damage associated with the existing fracture.

5. The method of claim 4, wherein selecting one or more remediative actions for the existing fracture, based, at least in part, on the conductivity damage, comprises:

selecting a remediative action for the existing fracture based on the degree and the depth of damage associated with the existing fracture.

6. The method of claim 1, wherein selecting one or more remediative actions for the existing fracture, based, at least in part, on the conductivity damage, comprises:

selecting one or more fracture treatments.

7. The method of claim 1, wherein selecting one or more remediative actions for the existing fracture, based, at least in part, on the conductivity damage, comprises:

selecting one or more reservoir treatments.

8. The method of claim 7, wherein selecting one or more reservoir treatments, comprises:

selecting one or more near-wellbore reservoir treatments.

9. The method of claim 1, further comprising:

performing one or more of the selected remediative actions.

10. A computer program, stored in a tangible medium, for evaluating a subterranean formation, the subterranean formation comprising one or more layers, the computer program comprising executable instructions that cause one or more processors to:

for one or more of the layers, determine whether there are one or more existing fractures in the layer, wherein the one or more layers are in a subterranean formation;

for one or more of the existing fractures:

measure, with a sensor, one or more parameters of the existing fracture;

determine conductivity damage to the existing fracture, based, at least in part, on one or more of the measured parameters of the existing fracture; and select one or more remediative actions for the existing fracture, based, at least in part, on the conductivity damage.

11. The computer program of claim 10, wherein the executable instructions that cause the at least one processor to determine conductivity damage to the existing fracture, based, at least in part, on one or more of the measured parameters of the existing fracture, further cause the at least one processor to:

determine a degree and a depth of damage associated with the existing fracture.

12. The computer program of claim 11, wherein the executable instructions that cause the at least one processor to select one or more remediative actions for the existing fracture, based, at least in part, on the conductivity damage, further cause the at least one processor to:

select a remediative action for the existing fracture based on the degree and the depth of damage associated with the existing fracture.

13. The computer program of claim 10, wherein the executable instructions that cause the at least one processor to select one or more remediative actions for the existing fracture, based, at least in part, on the conductivity damage, further cause the at least one processor to:

select one or more fracture treatments.

14. The computer program of claim 10, wherein the executable instructions that cause the at least one processor to select one or more remediative actions for the existing fracture, based, at least in part, on the conductivity damage, further cause the at least one processor to:

select one or more reservoir treatments.

15. The computer program of claim 10, wherein the executable instructions that cause the at least one processor to select one or more reservoir treatments, further cause the at least one processor to:

select one or more near-wellbore reservoir treatments.

16. A system for treating a subterranean formation, the subterranean formation comprising one or more layers, the system comprising:

one or more sensors to measure one or more parameters of one or more existing fractures;

at least one processor;

a memory comprising executable instructions that, when executed by the at least one processor, cause the at least one processor to:

for one or more of the layers, determine whether there are one or more existing fractures in the layer, wherein the one or more layers are in a subterranean formation;

for one or more of the existing fractures:

receive measurements of one or more parameters of one or more existing fracture;

determine conductivity damage to the existing fracture, based, at least in part, on one or more of the measured parameters of the existing fracture; and select one or more remediative actions for the existing fracture, based, at least in part, on the conductivity damage.

17. The system of claim 16, wherein the executable instructions that cause the at least one processor to determine conductivity damage to the existing fracture, based, at least in part, on one or more of the measured parameters of the existing fracture, further cause the at least one processor to:

determine a degree and a depth of damage associated with the existing fracture.

18. The system of claim 17, wherein the executable instructions that cause the at least one processor to select one or more remediative actions for the existing fracture, based, at least in part, on the conductivity damage, further cause the at least one processor to:

select a remediative action for the existing fracture based on the degree and the depth of damage associated with the existing fracture.

19. The system of claim 16, wherein the executable instructions that cause the at least one processor to select one or more remediative actions for the existing fracture, based, at least in part, on the conductivity damage, further cause the at least one processor to:

select one or more fracture treatments and one or more reservoir treatments.

20. The system of claim 16, further comprising:

one or more downhole tools configured to perform one or more of the selected remediative actions.

* * * * *